US009389585B2

(12) United States Patent
Kadowaki

(10) Patent No.: US 9,389,585 B2
(45) Date of Patent: Jul. 12, 2016

(54) IMAGE FORMING APPARATUS INCLUDING A DETACHABLE PROCESS UNIT AND A POSITIONING MEMBER

(71) Applicant: Sharp Kabushiki Kaisha, Osaka (JP)

(72) Inventor: Hideaki Kadowaki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/809,549

(22) Filed: Jul. 27, 2015

(65) Prior Publication Data

US 2015/0331388 A1 Nov. 19, 2015

Related U.S. Application Data

(63) Continuation of application No. 14/267,243, filed on May 1, 2014, now Pat. No. 9,122,239.

(30) Foreign Application Priority Data

Jul. 11, 2013 (JP) ..... 2013-145835

(51) Int. Cl.
*G03G 21/20* (2006.01)
*G03G 21/18* (2006.01)
*G03G 21/00* (2006.01)

(52) U.S. Cl.
CPC ..... *G03G 21/206* (2013.01); *G03G 21/1842* (2013.01); *G03G 21/0052* (2013.01)

(58) Field of Classification Search
CPC ..... G03G 21/0052; G03G 21/206; G03G 21/1842; G03G 2221/1645
USPC ..... 399/92, 98, 100, 355
See application file for complete search history.

(56) References Cited

U.S. PATENT DOCUMENTS

2006/0024083 A1* 2/2006 Hori ..... G03G 15/0258 399/93
2007/0146739 A1 6/2007 Igarashi
2008/0025749 A1 1/2008 Igarashi
2008/0050145 A1 2/2008 Hanano
2009/0123173 A1 5/2009 Kadowaki
2009/0162117 A1 6/2009 Yamada et al.

(Continued)

FOREIGN PATENT DOCUMENTS

JP 2006-017976 1/2006
JP 2009-122221 6/2009

(Continued)

OTHER PUBLICATIONS

Co-pending U.S. Appl. No. 14/267,243, filed May 1, 2014 (Application provided).

(Continued)

*Primary Examiner* — Rodney Bonnette
(74) *Attorney, Agent, or Firm* — Renner, Otto, Boisselle & Sklar, LLP

(57) ABSTRACT

An image forming apparatus includes a process unit, an exhaust path, and a positioning member movable between (i) a positioning position for positioning the process unit and (ii) a releasing position for releasing the process unit, the positioning member having an air path, the air path and the exhaust path being connected in a case where the positioning member is in the positioning position, and the air path and the exhaust path being disconnected in a case where the positioning member is in the releasing position.

7 Claims, 18 Drawing Sheets

(56) References Cited

U.S. PATENT DOCUMENTS

| | | | | |
|---|---|---|---|---|
| 2009/0269102 | A1 | 10/2009 | Kaneko et al. | |
| 2015/0185689 | A1 * | 7/2015 | Tanaka | G03G 21/1661 399/92 |

FOREIGN PATENT DOCUMENTS

| | | |
|---|---|---|
| JP | 2009-151111 | 7/2009 |
| JP | 2009-244539 | 10/2009 |

OTHER PUBLICATIONS

Notice of Allowance issued on Apr. 27, 2015 for co-pending U.S. Appl. No. 14/267,243.

Office Action issued on Jan. 2, 2015 for co-pending U.S. Appl. No. 14/267,243.

* cited by examiner

IMAGE FORMING APPARATUS INCLUDING A DETACHABLE PROCESS UNIT AND A POSITIONING MEMBER

This Nonprovisional application claims priority under 35 U.S.C. §119 on Patent Application No. 2013-145835 filed in Japan on Jul. 11, 2013, the entire contents of which are hereby incorporated by reference.

TECHNICAL FIELD

The present invention relates to an image forming apparatus which forms an image based on an electrophotographic printing method.

BACKGROUND ART

An image forming apparatus based on an electrophotographic printing method includes a photoreceptor drum, a laser scanning unit (hereinafter referred to as LSU), a charging device, and a developing device. Among them, for example, the photoreceptor drum and the charging device are mounted as an integrated process unit on the image forming apparatus. The LSU radiates laser light to the photoreceptor drum in accordance with image information, and the charging device evenly charges a surface of the photoreceptor drum.

A lens is provided on a light path of the LSU. The lens becomes tainted by fouling such as toner and dust as printing is carried out again and again. In order to deal with this, for example, Patent Literature 1 discloses a configuration in which such fouling is removed by a cleaning member.

In Patent Literature 1, a process unit is designed to be detachable from an image forming apparatus for the purpose of replacement etc. The image forming apparatus has a mechanism for positioning the process unit in front and rear directions of the image forming apparatus when the process unit is attached to the image forming apparatus. Furthermore, in a charging device included in the process unit, particularly in a charging device utilizing corona discharge, ozone is generated due to discharge. In order to deal with this, the charging device is required to take in air for exhausting the ozone. For example, Patent Literature 2 discloses a configuration in which a duct via which air is sent to a charging device is provided.

CITATION LIST

Patent Literatures

[Patent Literature 1]
Japanese Patent Application Publication No. 2009-244539 (published on Oct. 22, 2009)
[Patent Literature 2]
Japanese Patent Application Publication No. 2006-17976 (published on Jan. 19, 2006)

SUMMARY OF INVENTION

Technical Problem

Recently, since an image forming apparatus is getting smaller, members included in the image forming apparatus are required to be smaller and occupy a smaller space. However, the configuration disclosed in Patent Literature 2 does not respond to such a request. The configuration disclosed in Patent Literature 2 merely provides a duct and does not have any design for downsizing an image forming apparatus and reducing a space to be occupied by the image forming apparatus.

Therefore, an object of the present invention is to provide an image forming apparatus in which a mechanism for positioning a process unit and a mechanism for exhausting ozone generated in a charging section are downsized and occupy a smaller space.

Solution to Problem

In order to solve the foregoing problem, an image forming apparatus in accordance with one aspect of the present invention is an image forming apparatus for forming an image based on an electrophotographic printing method, including: a process unit detachable from the image forming apparatus, the process unit including at least a photoreceptor and a charging section for charging the photoreceptor; an exhaust path having, as a part of the exhaust path, a space where the charging section is provided; and a positioning member movable between (i) a positioning position for putting the process unit in a positioned state where the process unit is positioned at a predetermined position and (ii) a releasing position for releasing the process unit from the positioned state, the positioning member having an air path via which air is introduced, the air path and the exhaust path being connected in a case where the positioning member is in the positioning position, and the air path and the exhaust path being disconnected in a case where the positioning member is in the releasing position.

Advantageous Effects of Invention

With the one aspect of the present invention, the positioning member has a function of positioning the process unit and a function of the air path via which air is introduced into the exhaust path. Consequently, a mechanism for positioning the process unit and a mechanism for exhausting ozone generated in the charging section can be downsized and occupy a smaller space.

DESCRIPTION OF EMBODIMENTS

First Embodiment (Overall Configuration of Image Forming Apparatus)

Figure 1:
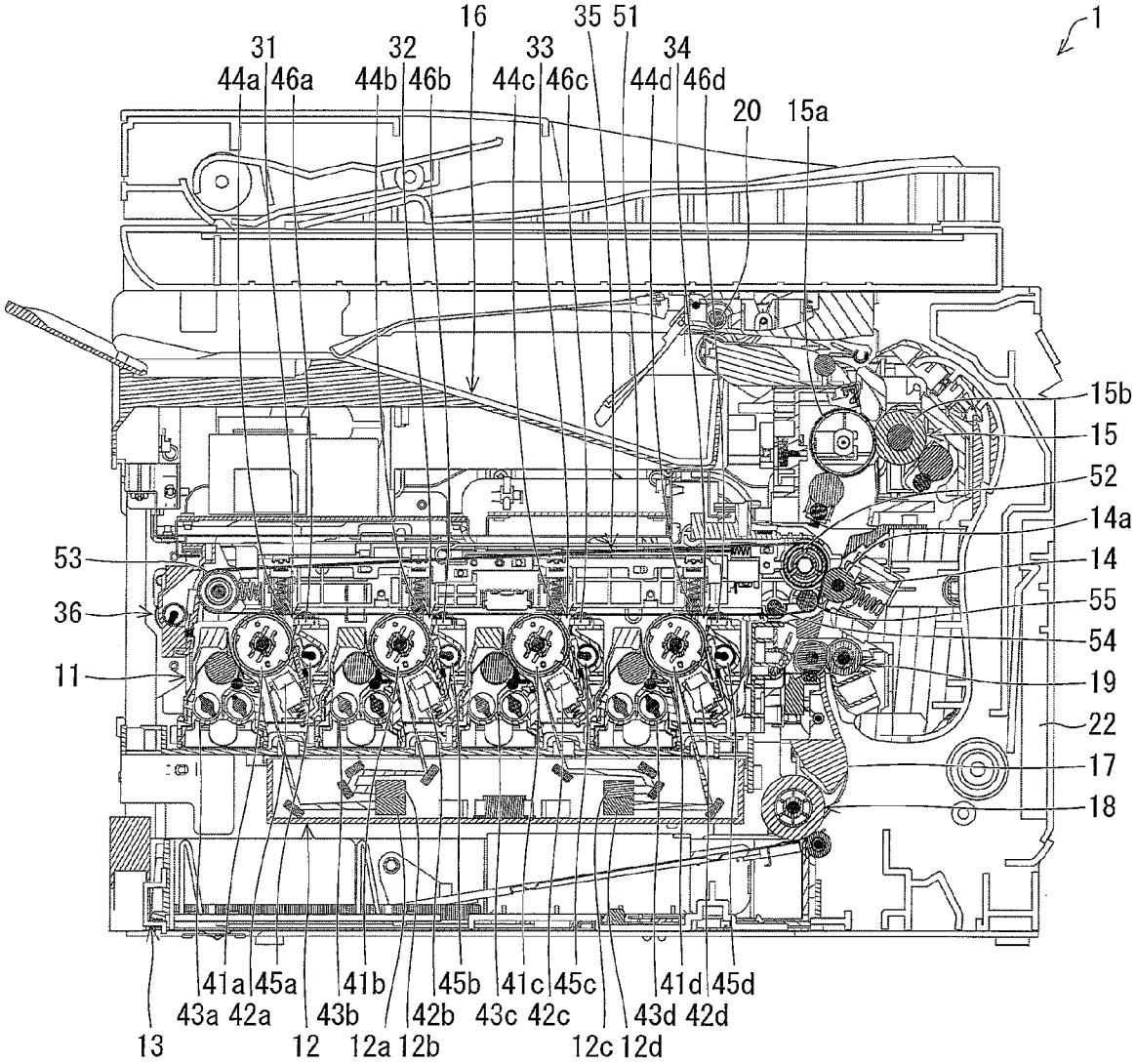
FIG. 1 is an elevation view illustrating a configuration inside an image forming apparatus in accordance with an embodiment of the present invention.

The following description will discuss an embodiment of the present invention with reference to drawings. FIG. 1 is an elevation view illustrating a configuration inside an image forming apparatus 1 in accordance with the embodiment of the present invention. In the present embodiment, the image forming apparatus 1 is a full-color printer. Accordingly, the image forming apparatus 1 prints a color image on a paper (sheet of recording medium) in accordance with image data supplied from outside. In FIG. 1, the image forming apparatus 1 is illustrated as a printer for example. However, the image forming apparatus 1 may be a copying machine, a facsimile machine, or a multifunction printer having a copying function and/or a facsimile function. In this case, the image forming apparatus 1 prints a multi-color image or a monochrome image on a paper in accordance with image data supplied from outside or image data read out from a document by a scanner.

As illustrated in FIG. 1, the image forming apparatus includes an image forming section 11 at a lower part thereof. At a position under the image forming section 11, a laser scanning unit (hereinafter referred to as LSU) 12 and a paper feeding cassette 13 are provided in this order from the above. Furthermore, a transfer section 14 is provided to a right side of the image forming section 11 when the image forming apparatus 1 is seen from a front thereof, and a fixing section 15 is provided above the transfer section 14 when the image forming apparatus 1 is seen from a front thereof.

A paper carrying path 17 is provided at a path extending from the paper feeding cassette 13 to a paper output tray 16. The paper carrying path 17 is provided with a paper feeding roller 18, a timing roller 19, the transfer section 14, the fixing section 15, and a paper output roller 20 in this order from the paper feeding cassette 13 toward the paper output tray 16.

The image forming section 11 includes first to fourth image forming sections 31 to 34, an intermediate transfer belt unit 35, and a transfer belt cleaning device 36. The first to fourth image forming sections 31 to 34 are for yellow, magenta, cyan, and black, respectively.

The image forming section 31 includes a photoreceptor drum (photoreceptor) 41*a*, a charging device 42*a*, a developing device 43*a*, an intermediate transfer roller 44*a*, a photoreceptor cleaner unit 45*a*, and a charge removing section 46*a*.

The charging device 42*a* is a scorotron charger which charges, by corona discharge, a surface of the photoreceptor drum 41*a* so that the surface has a predetermined potential. The developing device 43*a* develops, by using a toner, an electrostatic latent image which was formed on the surface of the photoreceptor drum 41*a* when the photoreceptor drum 41*a* was exposed to laser light from the LSU (laser radiating device) 12. The intermediate transfer roller 44*a* is provided at a back surface of the intermediate transfer belt 51, and transfers a toner image, which has been formed on the surface of the photoreceptor drum 41*a* as a result of the development, to a front surface of the intermediate transfer belt 51 of the intermediate transfer belt unit 35. After the development and the transfer of the toner image, the photoreceptor cleaner unit 45*a* removes and collects a remaining toner and paper powder on the surface of the photoreceptor drum 41*a*. The charge removing section 46*a* removes remaining charge on the surface of the photoreceptor drum 41*a*. The charging device 42*a* is not limited to a scorotron charger, and may be, for example, a corotron charger, a charging roller, a charging brush, or a creeping discharger.

Similarly, the second image forming section 32 includes a photoreceptor drum 41*b*, a charging device 42*b*, a developing device 43*b*, an intermediate transfer roller 44*b*, a photoreceptor cleaner unit 45*b*, and a charge removing section 46*b*. The third image forming section 33 includes a photoreceptor drum 41*c*, a charging device 42*c*, a developing device 43*c*, an intermediate transfer roller 44*c*, a photoreceptor cleaner unit 45*c*, and a charge removing section 46*c*. The fourth image forming section 34 includes a photoreceptor drum 41*d*, a charging device 42*d*, a developing device 43*d*, an intermediate transfer roller 44*d*, a photoreceptor cleaner unit 45*d*, and a charge removing section 46*d*.

The intermediate transfer belt unit 35 includes the intermediate transfer belt 51, a driving roller 52 for supporting the intermediate transfer belt 51, a driven roller 53, and tension rollers 54 and 55. The transfer belt cleaning device 36 removes a remaining toner and paper powder on the surface of the intermediate transfer belt 51.

The LSU 12 includes laser light sources 12*a* to 12*d* corresponding to the photoreceptor drums 41*a* to 41*d*, respectively. The laser light sources 12*a* to 12*d* radiate laser lights to the photoreceptor drums 41*a* to 41*d*, respectively, so as to form, on surfaces of the photoreceptor drums 41*a* to 41*d*, electrostatic latent images corresponding to an image to be printed by the image forming apparatus 1.

The transfer section 14 includes a transfer roller 14*a* to be pressed to the driving roller 52 of the intermediate transfer belt unit 35 via the intermediate transfer belt 51. The transfer section 14 transfers the toner image on the front surface of the intermediate transfer belt 51 to a paper supplied from the paper feeding cassette 13. The fixing section 15 includes a fixing roller 15*a* and a pressure roller 15*b*, and fixes the toner image onto the paper by melting the toner image.

(Image Forming Operation)

In the image forming apparatus 1 having the above configuration, in printing a color image, the LSU 12 radiates laser lights to the photoreceptor drums 41*a* to 41*d* in accordance with input image data, and electrostatic latent images are formed on the photoreceptor drums 41*a* to 41*d*, respectively. The electrostatic latent images thus formed are developed by using toners supplied from the developing devices 43*a* to 43*d*, so that a yellow toner image, a magenta toner image, a cyan toner image, and a black toner image are formed on the surfaces of the photoreceptor drums 41*a* to 41*d*, respectively.

The toner images are transferred to the same position on the intermediate transfer belt 51 of the intermediate transfer belt unit 35 in such a manner that the toner images are sequentially superimposed, and a resulting toner image is transferred onto a paper by the transfer section 14. The paper is sent from the paper feeding cassette 13 to the paper carrying path 17 by the paper feeding roller 18, and is supplied by the timing roller 19 to the transfer section 14 at timing when the paper matches the toner image on the intermediate transfer belt 51.

The paper onto which the toner image has been transferred by the transfer section 14 is carried to the fixing section 15, and the fixing section 15 fixes the toner image onto the paper. Thereafter, the paper is outputted onto the paper output tray 16 by the paper output roller 20.

(Process Unit)

Figure 2:
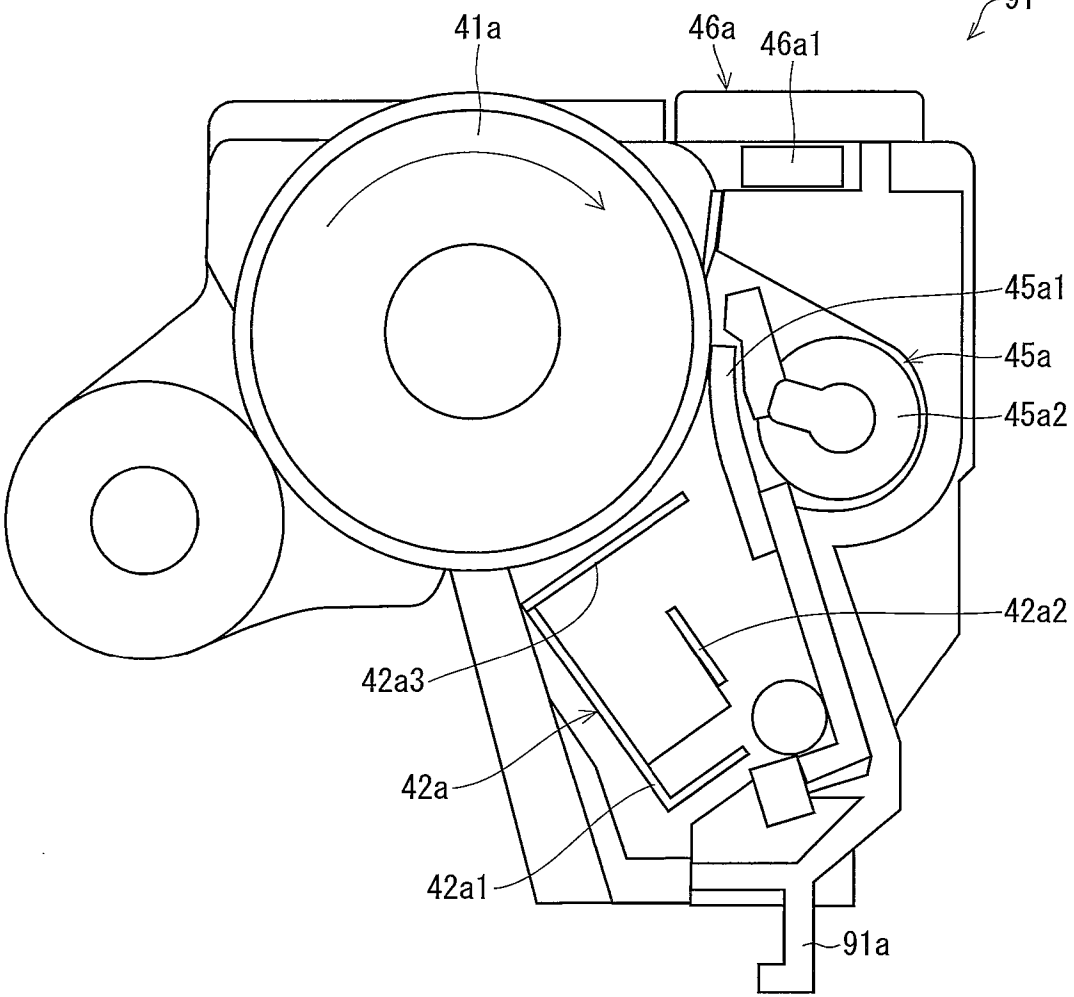
FIG. 2 is an elevation view illustrating a process unit included in each of the first to fourth image forming sections illustrated in FIG. 1.

FIG. 2 is an elevation view illustrating a process unit 91 included in each of the first to fourth image forming sections 31 to 34. FIG. 2 illustrates, as an example, the process unit 91 included in the first image forming section 31.

As illustrated in FIG. 2, the process unit 91 includes the photoreceptor drum 41*a*, the charging device (charging section, exhaust path) 42*a*, the photoreceptor cleaner unit 45*a*, and the charge removing section 46*a* which are formed integrally. The process unit 91 is detachable from the image forming apparatus 1.

The photoreceptor cleaner unit 45*a* includes a cleaning blade 45*a*1 and a waste toner screw 45*a*2. The cleaning blade 45*a*1 touches the surface of the photoreceptor drum 41*a*, and removes foreign matters such as a remaining toner on the surface of the photoreceptor drum 41*a*. The waste toner screw 45*a*2 supplies the foreign matters such as the remaining toner removed from the surface of the photoreceptor drum 41*a* by the cleaning blade 45*a*1 to a waste toner box (not illustrated). The waste toner box is positioned between a front side of the image forming apparatus 1 and the process unit 91.

The charge removing section 46*a* includes a charge removing lens 46*a*1. The charge removing lens 46*a*1 evenly radiates light from an LED lamp (not illustrated) positioned at a rear part of the image forming apparatus 1 to the surface of the photoreceptor drum 41*a* in such a manner that the light is radiated to the surface of the photoreceptor drum 41*a* evenly in an axis direction of the photoreceptor drum 41*a*. This removes remaining charge on the surface of the photoreceptor drum 41*a*.

The charging device 42*a* includes a shield case 42*a*1, a discharging electrode 42*a*2, and a grid electrode 42*a*3. The discharging electrode 42*a*2 is, for example, an electrode having a saw blade shape.

(Structure of Peripherals of Process Unit)

Figure 3:
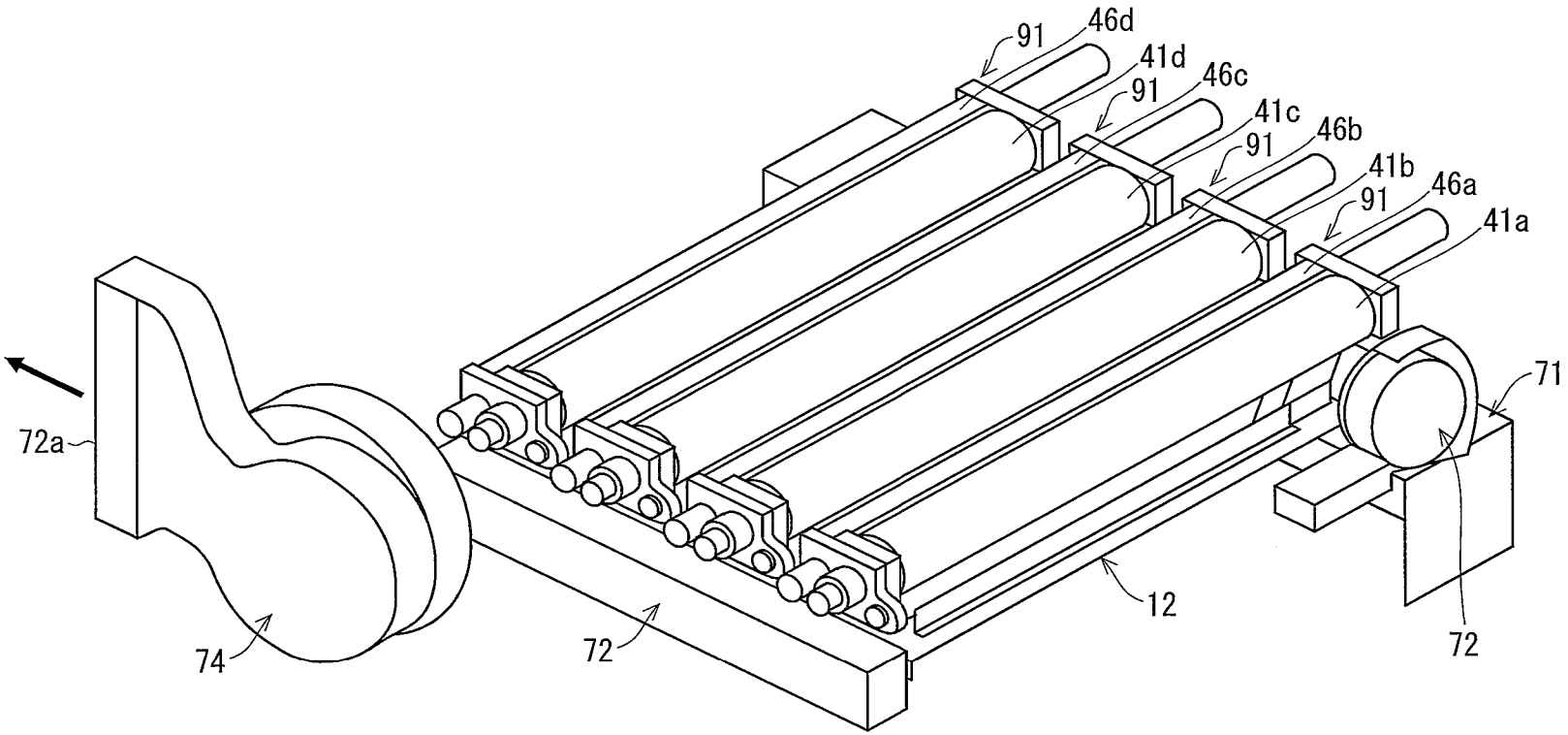
FIG. 3 is a perspective view illustrating structures of the process unit illustrated in FIG. 2 and its peripherals seen obliquely from behind and above of the image forming apparatus.
Figure 4:
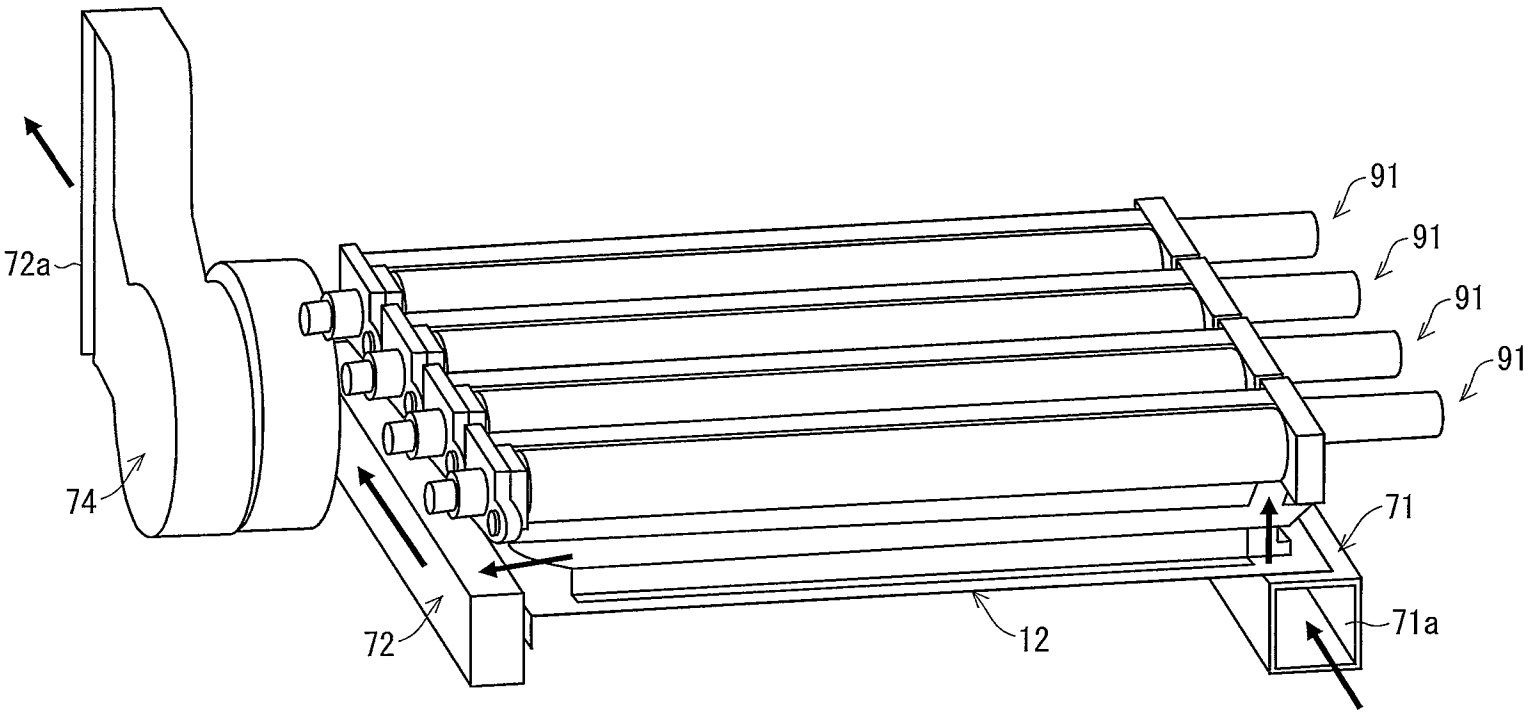
FIG. 4 is a perspective view illustrating the structures of FIG. 3 seen sideways and obliquely from above the image forming apparatus.
Figure 5:
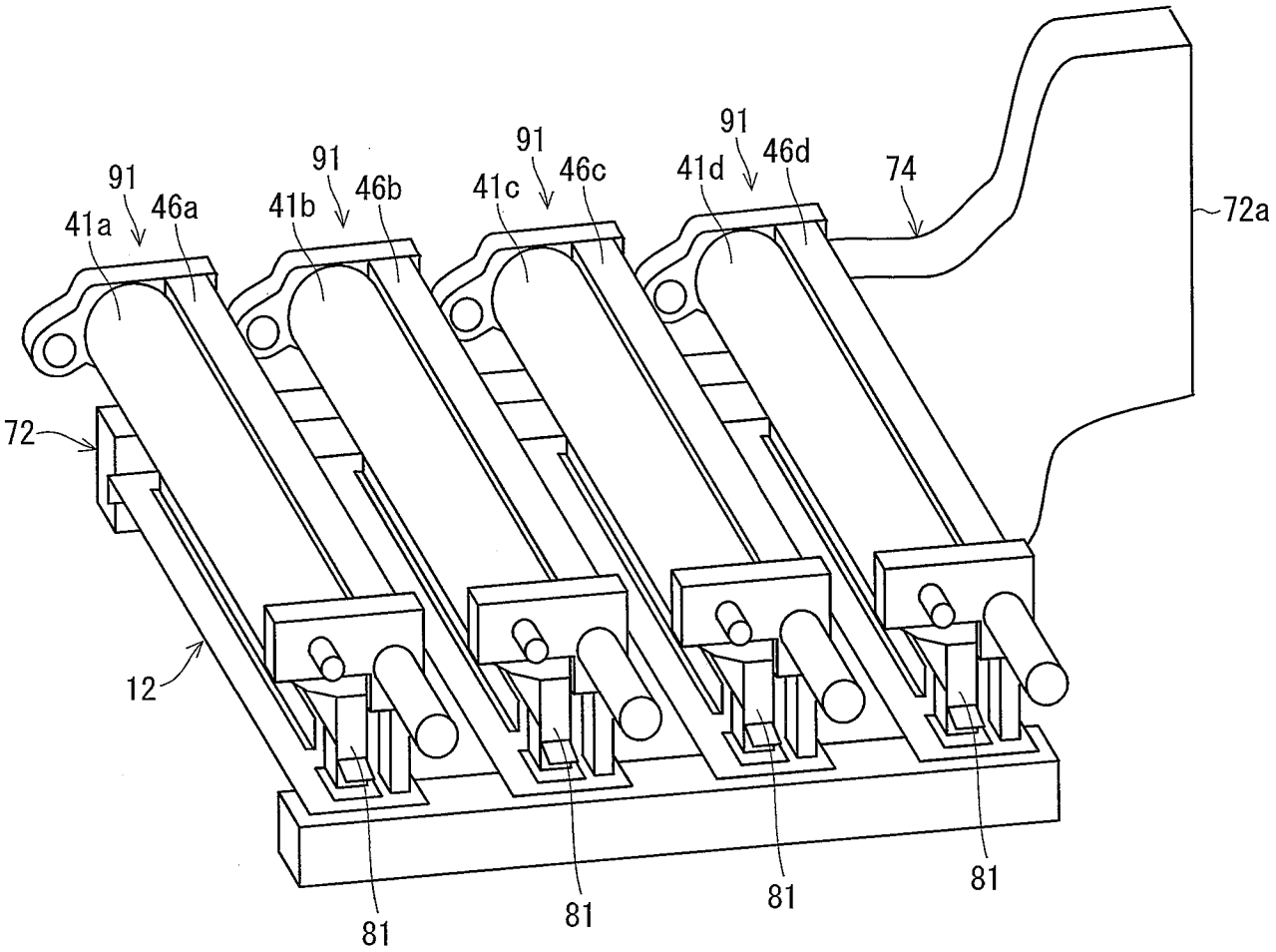
FIG. 5 is a perspective view illustrating the structures of FIG. 3 seen frontally and obliquely from above the image forming apparatus.
Figure 6:
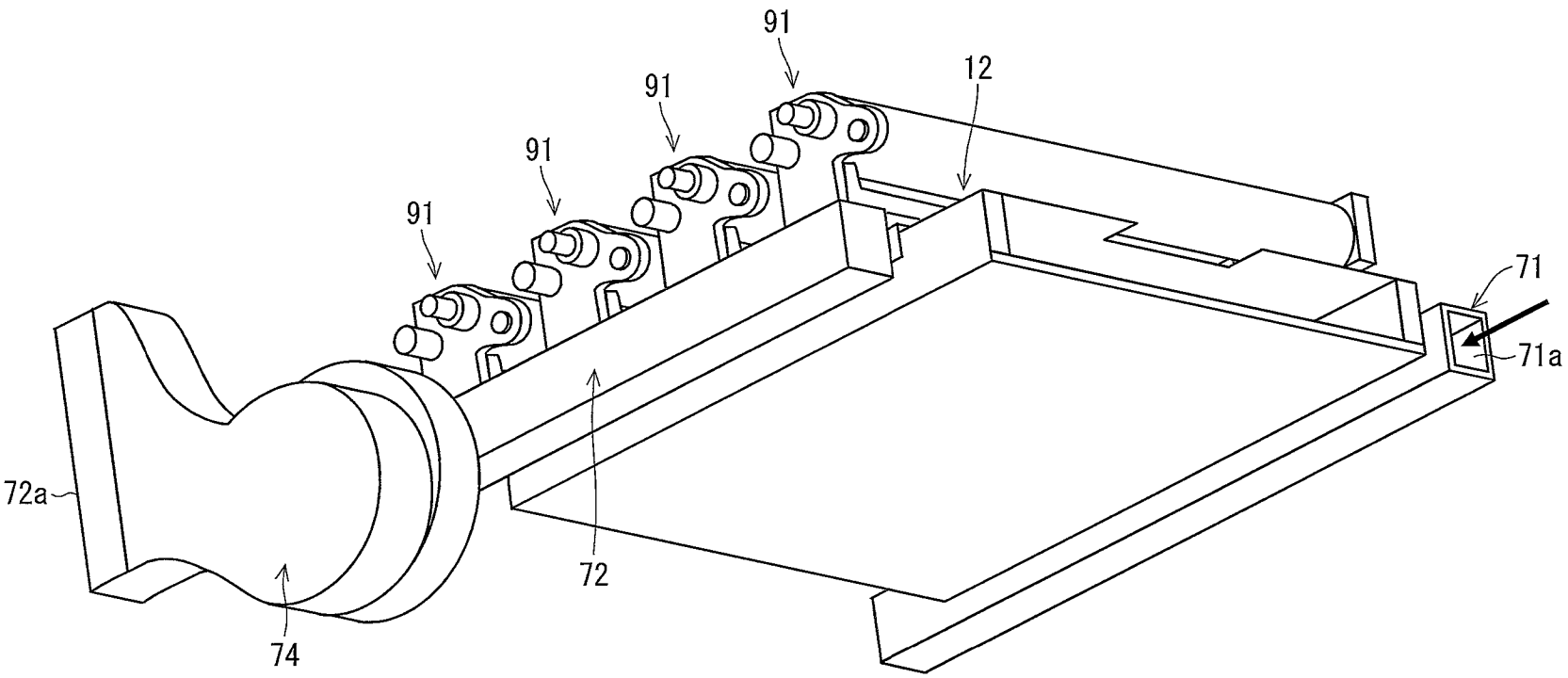
FIG. 6 is a perspective view illustrating the structures of FIG. 3 seen sideways and obliquely from below the image forming apparatus.

FIG. 3 is a perspective view illustrating structures of the process unit 91 and its peripherals seen obliquely from behind and above the image forming apparatus 1. FIG. 4 is a perspective view illustrating the structures of FIG. 3 seen sideways and obliquely from above the image forming apparatus 1. FIG. 5 is a perspective view illustrating the structures of FIG. 3 seen frontally and obliquely from above the image forming apparatus 1. FIG. 6 is a perspective view illustrating the structures of FIG. 3 seen sideways and obliquely from below the image forming apparatus 1.

As illustrated in FIGS. 3 to 6, the photoreceptor drums 41*a* to 41*d* are positioned to be parallel with each other and horizontally, with their axis directions being equal to front and rear directions of the image forming apparatus 1. Under a front part of the process unit 91, an intake duct 71 which extends in a direction in which the photoreceptor drums 41*a* to 41*d* are aligned is provided. Similarly, under a rear part of the process unit 91, an exhaust duct (exhaust path) 72 which extends in a direction in which the photoreceptor drums 41*a* to 41*d* are aligned is provided. The intake duct 71 is formed by attaching, for example, PET sheet materials to each other.

The intake duct 71 takes in air (outside air) via an intake opening 71*a* (see FIG. 6). For this purpose, the intake opening 71*a* is positioned inside a louver in a housing of the image forming apparatus 1. Air taken into the intake duct 71 reaches the exhaust duct 72 via a space inside the charging device 42*a*, and is exhausted to the outside of the image forming apparatus 1 via the exhaust opening 72*a* of the exhaust duct 72. For this purpose, the exhaust opening 72*a* is positioned, similarly with the intake opening 71*a*, inside a louver in the housing of the image forming apparatus 1.

(Structure of Attachment Section of Process Unit)

Figure 7:
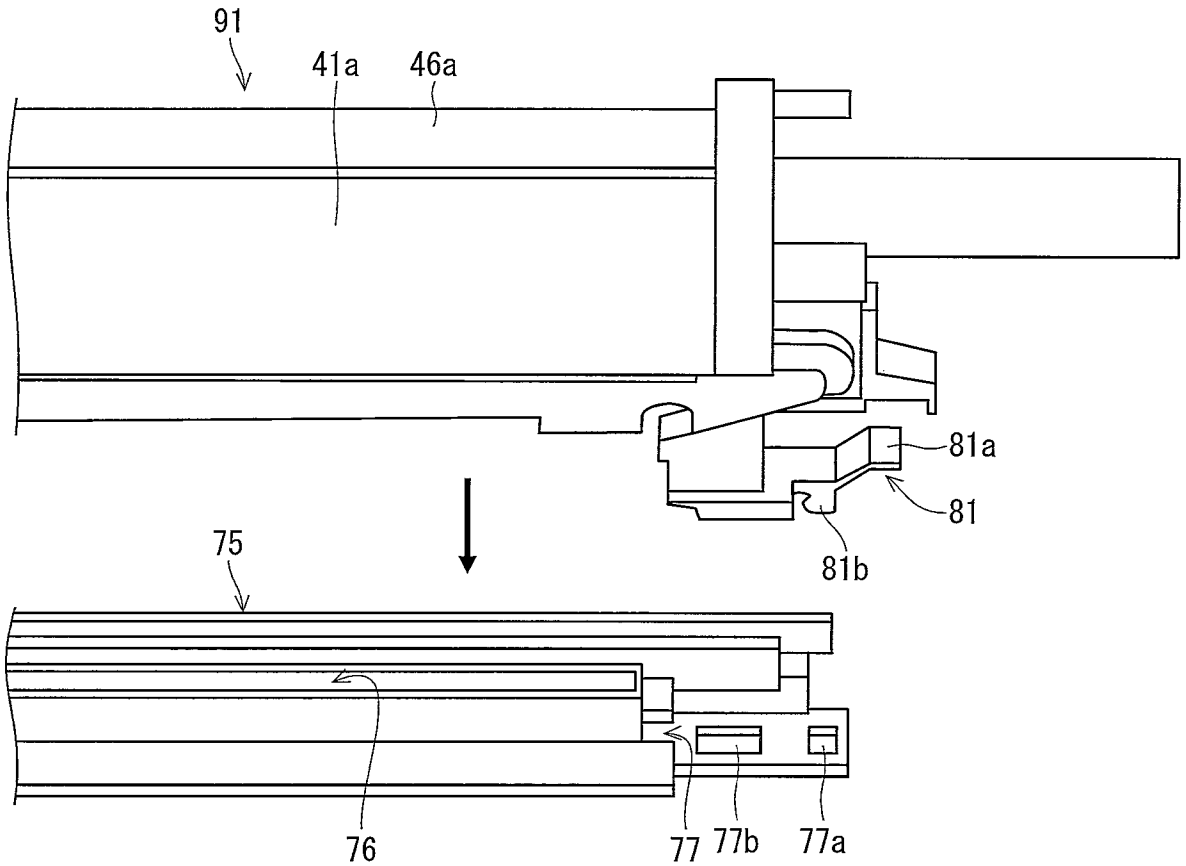
FIG. 7 is a perspective view illustrating a guiderail on a top surface of the LSU in FIG. 3 and a process unit to be attached onto the LSU.
Figure 8:
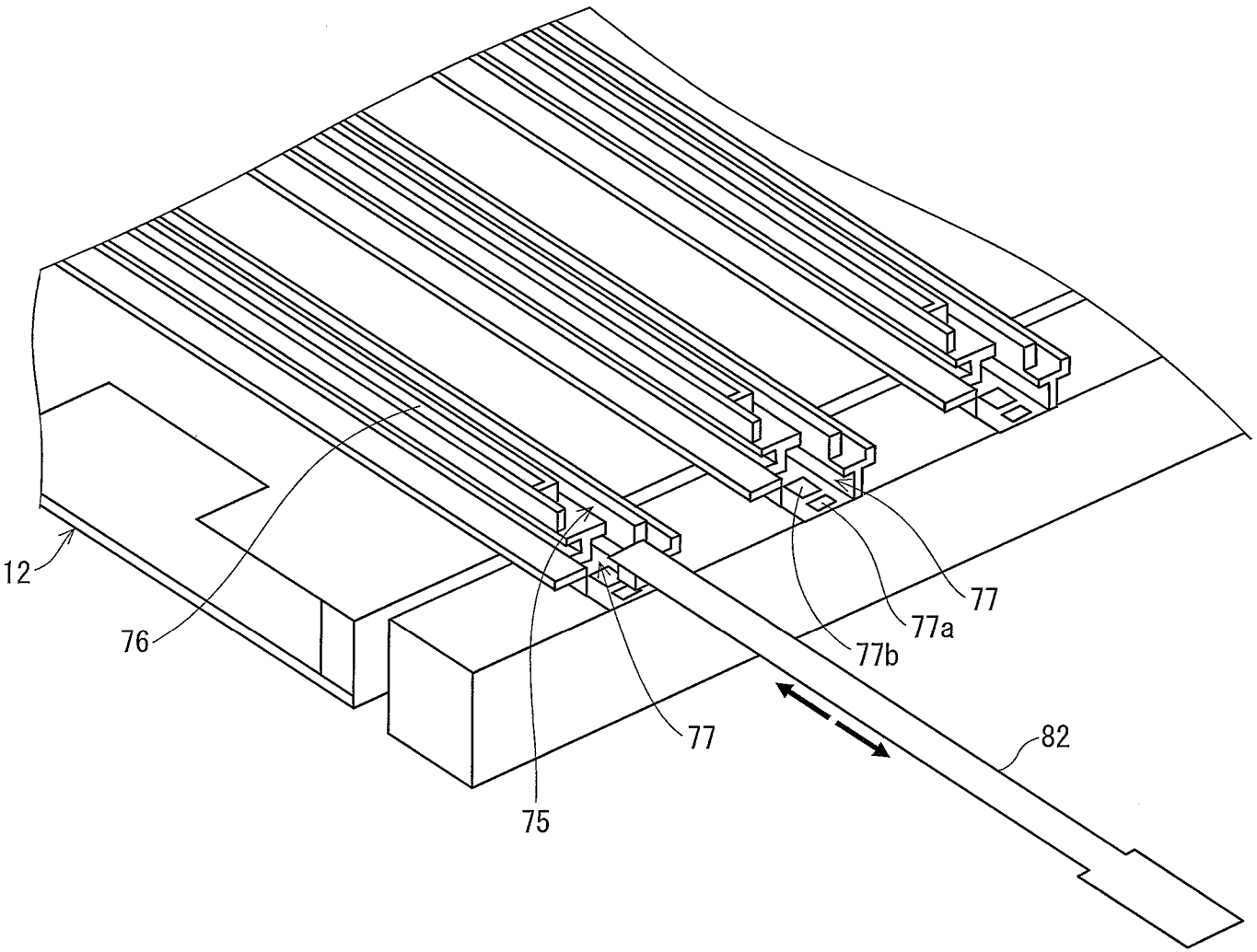
FIG. 8 is a perspective view illustrating a structure of the top surface of the LSU in FIG. 5 from which the process unit has been dismounted.

FIG. 7 is a perspective view illustrating a guide rail 75 on a top surface of the LSU 12 and the process unit 91 to be attached onto the LSU 12. FIG. 8 is a perspective view illustrating a structure of the top surface of the LSU 12 from which the process unit 91 has been dismounted.

The process unit 91 is attached onto the LSU 12. The process unit 91 has a rail 91*a* (see FIG. 2) on a bottom surface thereof. The LSU 12 has the guide rail 75 having a gutter shape on the top surface thereof in such a manner that the guide rail 75 guides the rail 91*a* (see FIGS. 7 and 8). An LSU lens (covering member) 76 is provided at a bottom section of a gutter-shaped portion adjacent to the guide rail 75. Laser light emitted from the LSU 12 is radiated to the photoreceptor drum 41*a* via the LSU lens 76.

As illustrated in FIG. 7 for example, the process unit 91 is provided with a positioning lever (positioning member) 81 for positioning the process unit 91 at a predetermined position in front and rear directions of the image forming apparatus 1 when the process unit 91 is attached onto the LSU 12. The positioning lever 81 includes (i) a handling section 81*a* via which a user handles the positioning lever 81 and (ii) a positioning protrusion 81*b*. The positioning protrusion 81*b* protrudes downward from a bottom surface of the handling section 81*a*. On the other hand, as illustrated in FIG. 8, a gutter section 77, which is adjacent to the guide rail 75 on the LSU 12 and is along the guide rail 75, has a positioning hole 77*a* at a front end of the gutter section 77. The positioning protrusion 81*b* is inserted into the positioning hole 77*a*. Furthermore, the gutter section 77 has a through-hole 77*b* at a position located inward with respect to the image forming apparatus 1 compared with the positioning hole 77*a* of the gutter section 77.

Therefore, when attaching the process unit 91, a user positions the rail 91*a* of the process unit 91 at the guide rail 75 and slides the process unit 91 from a front side to a rear side of the image forming apparatus 1 so that the process unit 91 reaches a predetermined position. Thereafter, the user handles the handling section 81*a* of the positioning lever 81 so that the positioning protrusion 81*b* is inserted into the positioning hole 77*a*. Consequently, the process unit 91 is positioned at the predetermined position on the LSU 12 in front and rear directions of the image forming apparatus 1.

(Structures of Positioning Lever and its Peripherals)

Figure 9:
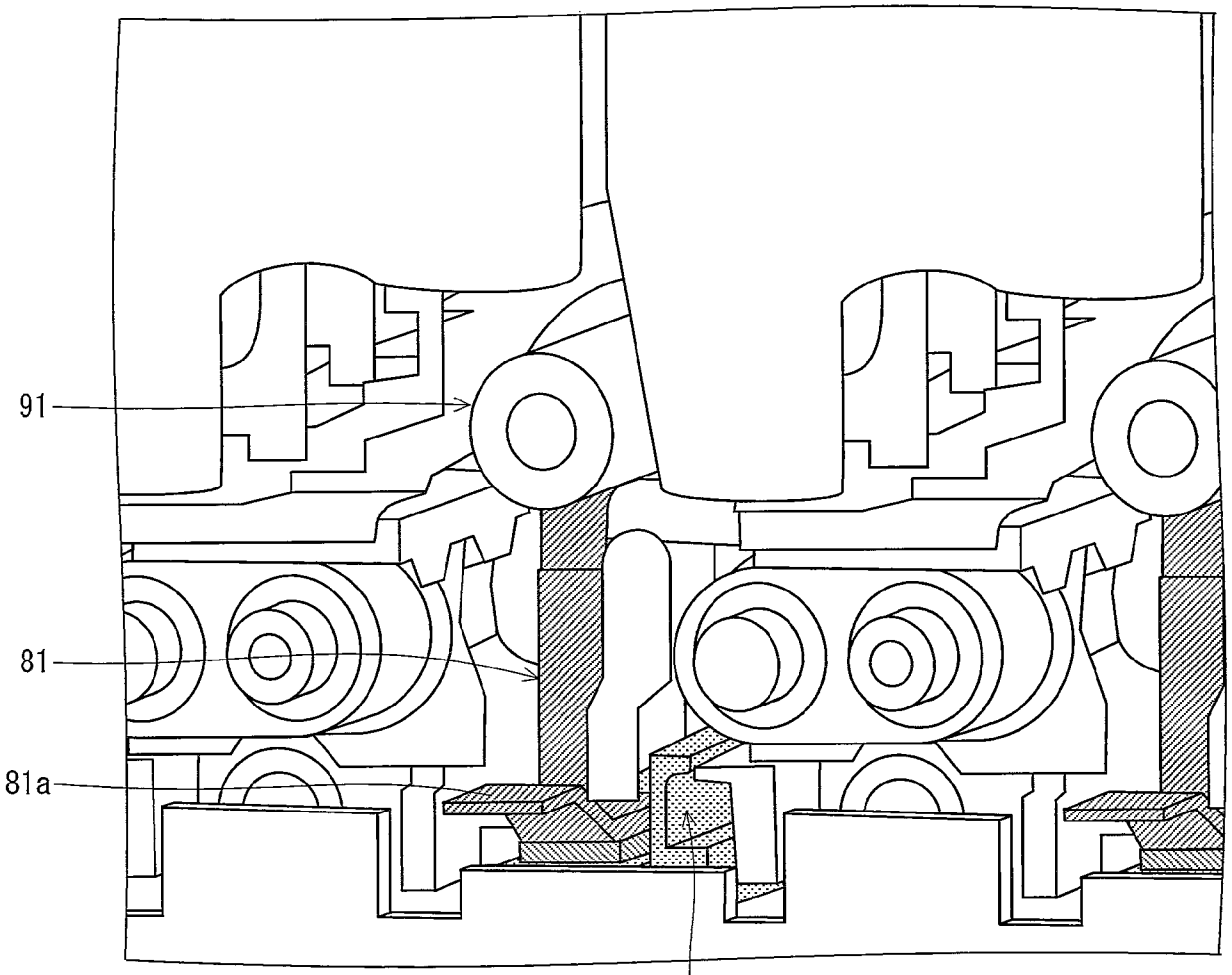
FIG. 9 is a perspective view illustrating structures of the positioning lever in FIG. 5 and its peripherals when the positioning lever is in a positioning state.
Figure 10:
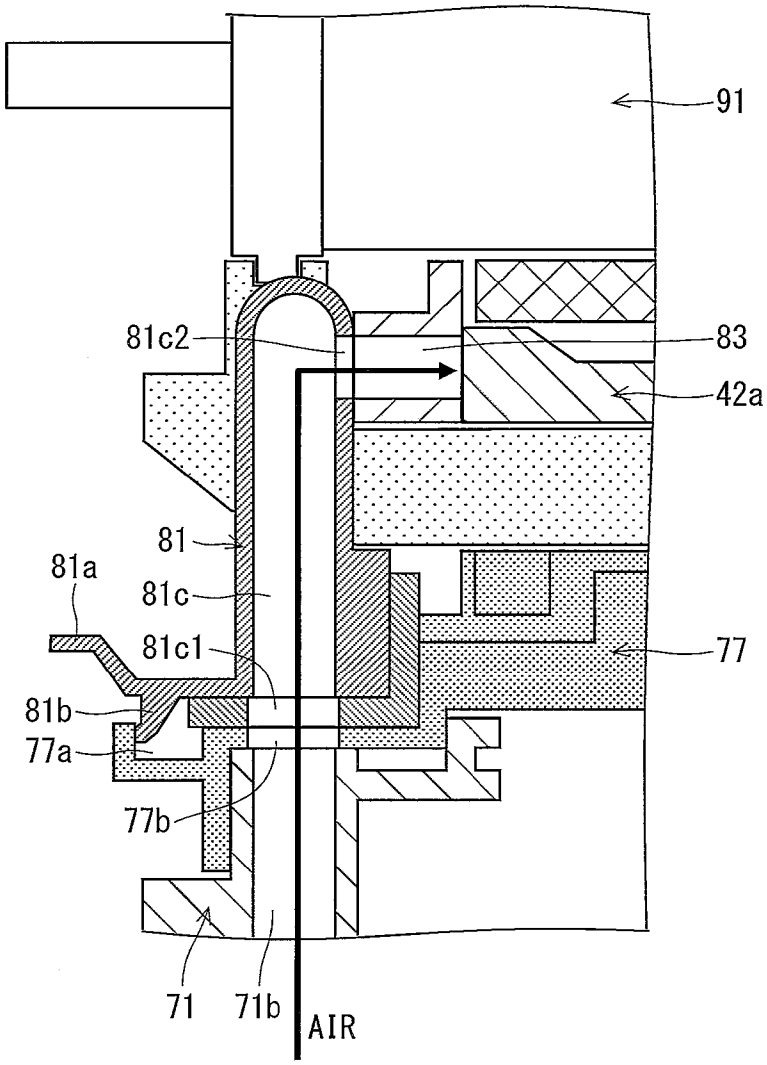
FIG. 10 is a longitudinal cross section view illustrating the structures of the positioning lever and its peripherals in the state illustrated in FIG. 9.
Figure 11:
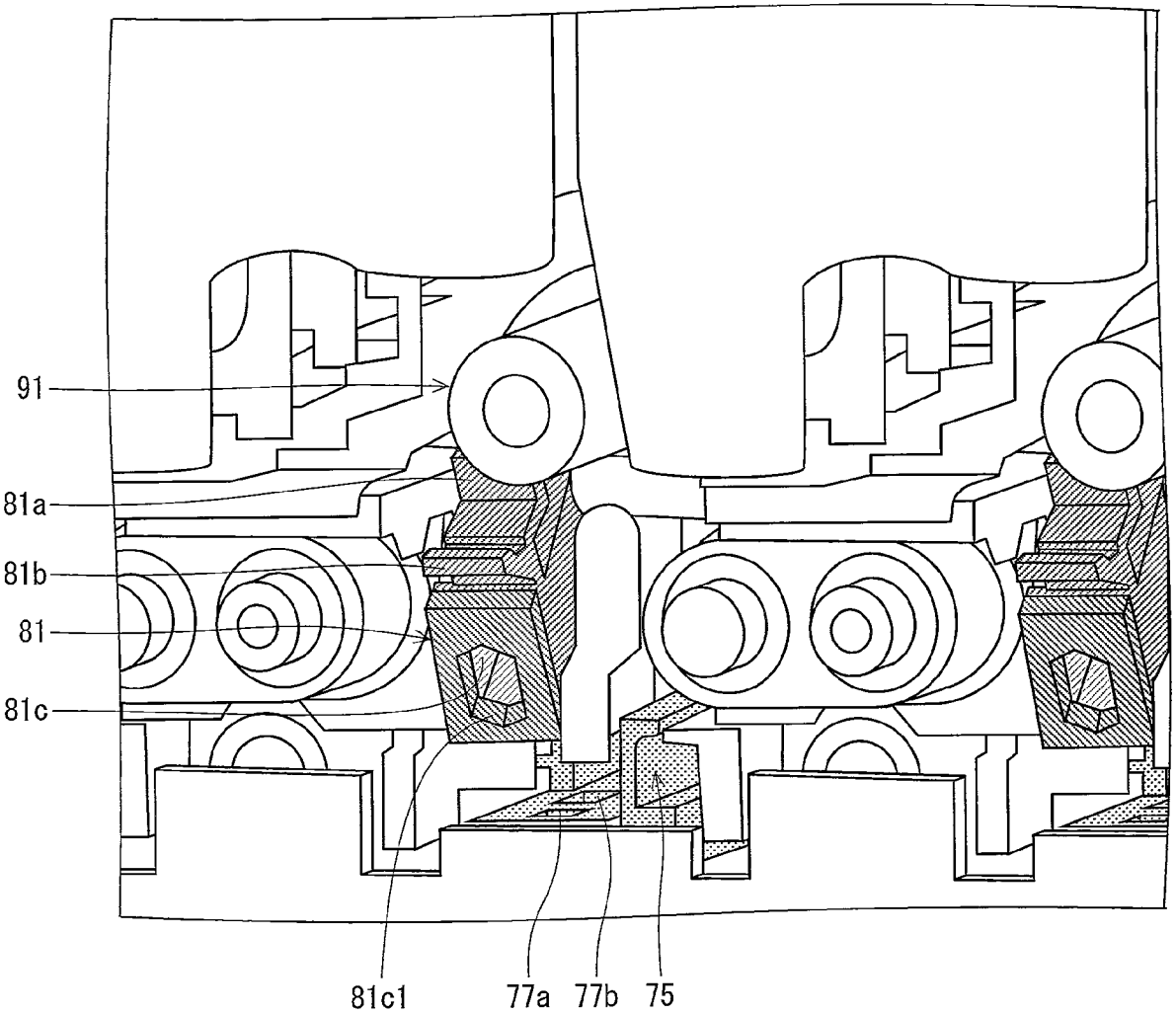
FIG. 11 is a perspective view illustrating the structures of the positioning lever in FIG. 5 and its peripherals when the positioning lever is in a releasing state.
Figure 12:
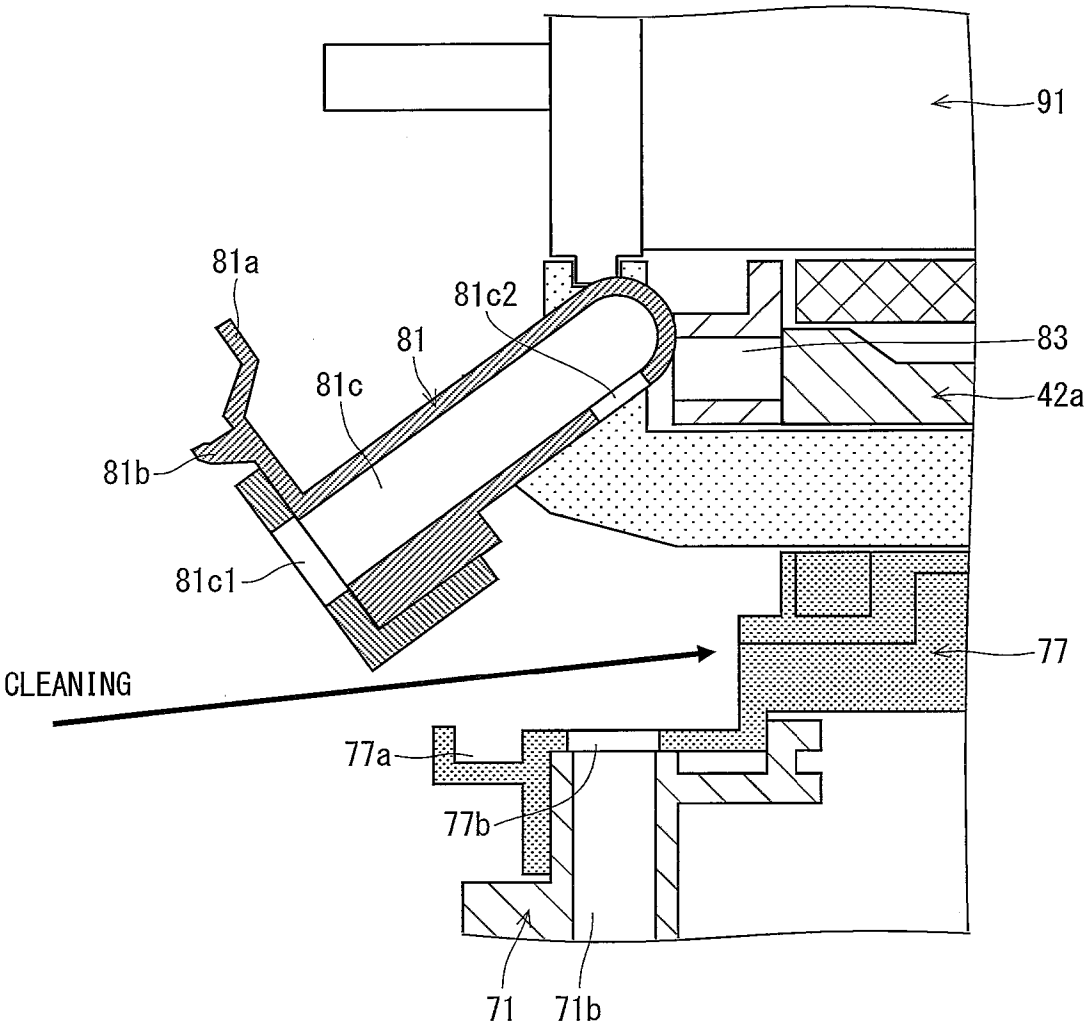
FIG. 12 is a longitudinal cross section view illustrating the structures of the positioning lever and its peripherals in the state illustrated in FIG. 11.

The following description will discuss structures of the positioning lever 81 and its peripherals. FIG. 9 is a perspective view illustrating structures of the positioning lever 81 and its peripherals when the positioning lever 81 is in a positioning state. FIG. 10 is a longitudinal cross section view illustrating the structures of the positioning lever 81 and its peripherals in the state illustrated in FIG. 9. FIG. 11 is a perspective view illustrating the structures of the positioning lever 81 and its peripherals when the positioning lever 81 is in a releasing state. FIG. 12 is a longitudinal cross section view illustrating the structures of the positioning lever 81 and its peripherals in the state illustrated in FIG. 11.

The positioning lever 81 can be rotated by a manual handling between a positioning position (positioning state) illustrated in FIGS. 9 and 10 and a releasing position (releasing state) illustrated in FIGS. 11 and 12. In the present embodiment, the center of rotation of the positioning lever 81 is positioned upward from the center of the positioning lever 81 in up and down directions thereof.

The positioning lever 81 has therein an air path 81*c* from a bottom surface of the positioning lever 81 to a side surface at an upper part of the positioning lever 81. An end at the bottom surface of the positioning lever 81 serves as an air path entrance 81*c*1, and an end at the side surface at the upper part of the positioning lever 81 serves as an air path exit 81*c*2.

The through-hole 77*b* of the gutter section 77 (see FIG. 8) of the LSU 12 is positioned to be connected with the air path entrance 81*c*1 of the positioning lever 81 thereby to communicate with the air path 81*c* when the positioning lever 81 is in the positioning position. An exhaust opening 71*b* of the intake duct 71 is provided under the through-hole 77*b*.

On the other hand, a connecting path 83 connected with a housing of the charging device 42*a* is positioned to be connected with the air path exit 81*c*2 of the positioning lever 81. The housing of the charging device 42*a* is constituted by, for example, the shield case 42*a*1 (see FIG. 2) of the charging device 42*a*. Consequently, the connecting path 83, the charging device 42*a*, and the exhaust duct 72 constitute an exhaust path.

As illustrated in FIG. 10, when the positioning lever 81 is in the positioning position, the through-hole 77*b* and the exhaust opening 71*b* are connected with the air path entrance 81*c*1 of the air path 81*c* of the positioning lever 81. Furthermore, the connecting path 83 connected with the housing of the charging device 42*a* is connected with the air path exit 81*c*2 of the air path 81*c* of the positioning lever 81.

An opening (not illustrated) of the housing of the charging device 42*a* which opening is opposite to the opening connected with the connecting path 83 is connected with the exhaust duct 72. Consequently, when the positioning lever 81 is in the positioning position, rotation of an exhaust fan 74 takes in air via the intake opening 71*a* of the intake duct 71, and the air passes through the intake duct 71, the air path 81*c* of the positioning lever 81, the connecting path 83, the charging device 42*a*, and the exhaust duct 72, and is exhausted to the outside of the image forming apparatus 1 via the exhaust opening 72*a* of the exhaust duct 72.

With the arrangement, when the process unit 91 is attached onto the LSU 12 of the image forming apparatus 1, putting the positioning lever 81 in the positioning position allows positioning the process unit 91 at a predetermined attaching position.

Furthermore, in this state, rotation of the exhaust fan 74 takes in air via the intake opening 71*a* of the intake duct 71, and the air passes through the intake duct 71, the air path 81*c* of the positioning lever 81, the connecting path 83, the charging device 42*a*, and the exhaust duct 72, and is exhausted to the outside of the image forming apparatus 1 via the exhaust opening 72*a* of the exhaust duct 72. Consequently, ozone generated by corona discharge of the charging device 42*a* can be exhausted to the outside of the image forming apparatus 1.

A top surface of the LSU lens 76 becomes tainted by fouling such as toner and dust as printing is carried out again and again. In order to deal with this, the top surface of the LSU lens 76 is cleaned by a cleaning member. In this case, as illustrated in FIG. 12, the positioning lever 81 is rotated upward so as to be in the releasing position. In this state, an LSU cleaning rod (cleaning member) 82 is inserted via a space formed between the positioning lever 81 and the upper surface of the LSU 12 so as to clean the top surface of the LSU lens 76. The LSU cleaning rod 82 has a cleaning pad at a front end thereof.

When the positioning lever 81 is put in the releasing position, the upper surface of the positioning lever 81 blocks the entrance of the connecting path 83. Accordingly, it is possible to prevent foreign matters from entering into the charging device 42*a* when the positioning lever 81 is in the releasing position.

As described above, the positioning lever 81 has both of (i) a function of positioning the process unit 91 in front and rear directions of the image forming apparatus 1 and (ii) a function of an air path via which air is sent to the charging device 42*a*. Consequently, the image forming apparatus 1 having a mechanism for positioning the process unit 91 and a mechanism for sending air to the charging device 42*a* can be designed to be downsized and occupy a smaller space.

Second Embodiment

The following description will discuss another embodiment of the present invention with reference to drawings.

As illustrated in FIGS. 13 to 18, an image forming apparatus 1 in accordance with the present embodiment includes a positioning lever (positioning member) 111 instead of the positioning lever 81. The positioning lever 81 has the function of positioning the process unit 91 and the function of an air path to the charging device 42*a*, whereas the positioning lever 111 has, in addition to these functions, a function of a path via which the top surface of the LSU lens 76 is cleaned. A detailed description will be provided below as to a configuration of the present embodiment.

(Structures of Positioning Lever and its Peripherals)

Figure 13:
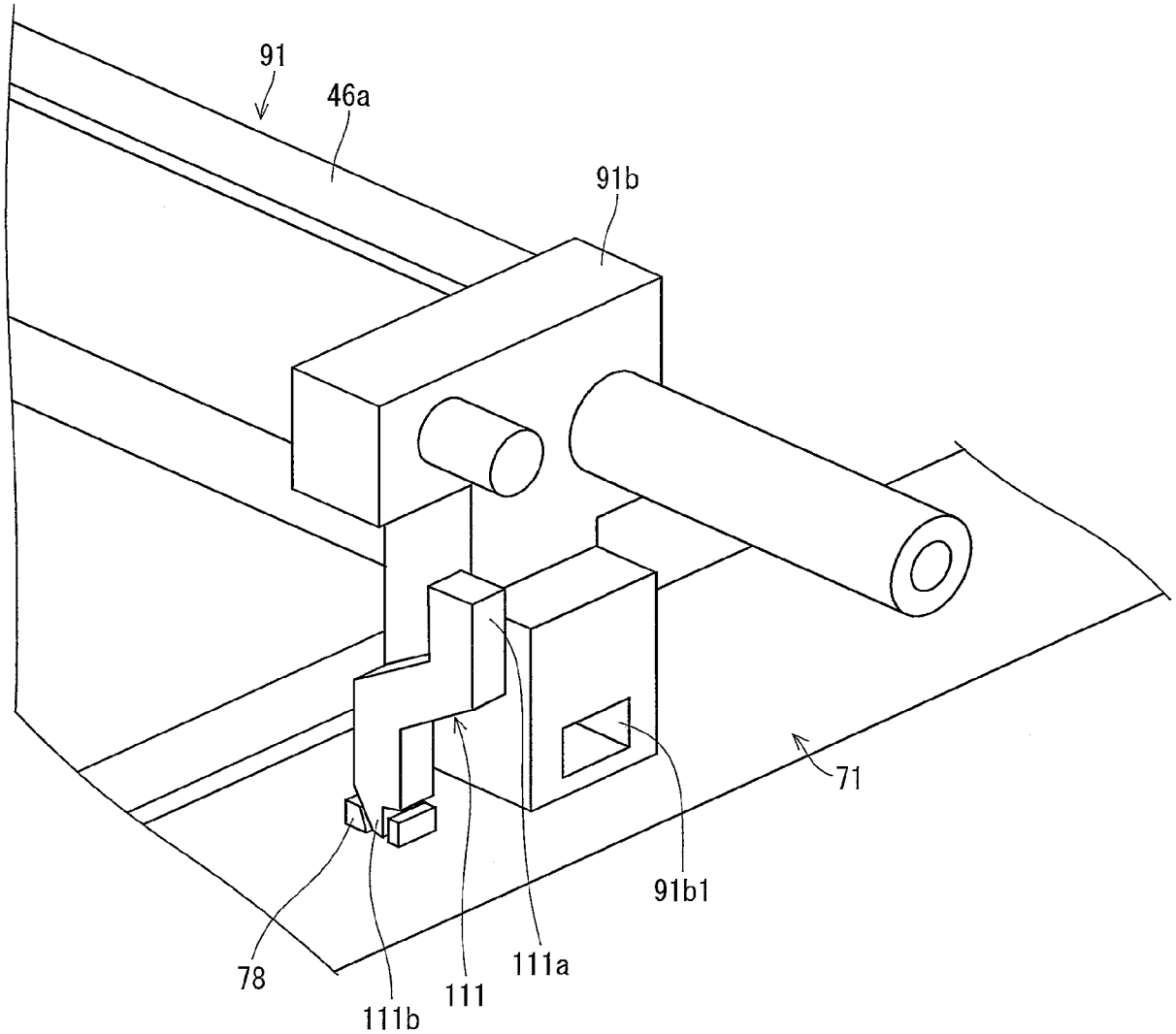
FIG. 13 is a perspective view illustrating structures of a positioning lever and its peripherals of an image forming apparatus in accordance with another embodiment of the present invention when the positioning lever is in a positioning state.
Figure 14:
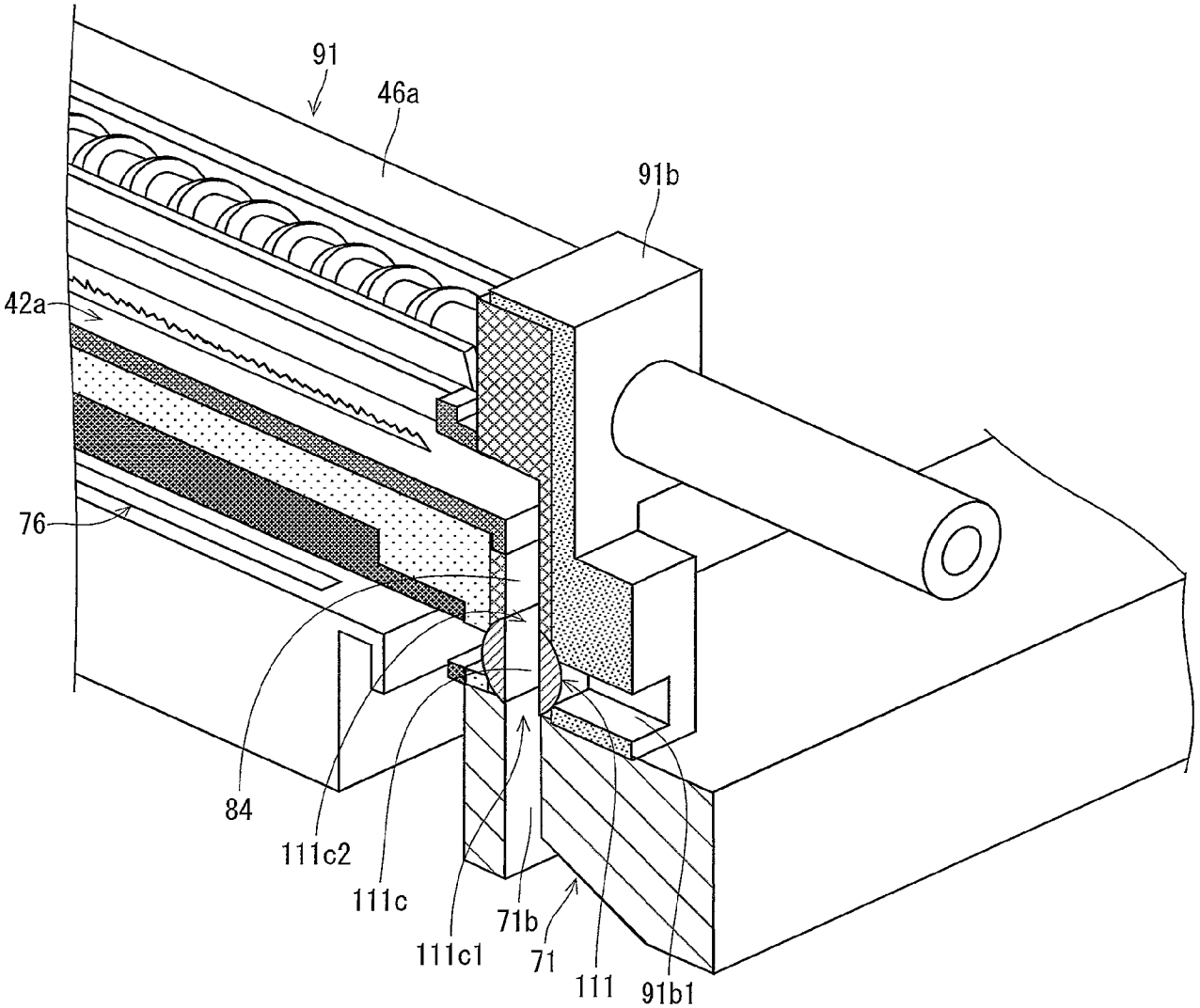
FIG. 14 is a longitudinal cross section view illustrating structures of the positioning lever and its peripherals in the state illustrated in FIG. 13.
Figure 15:
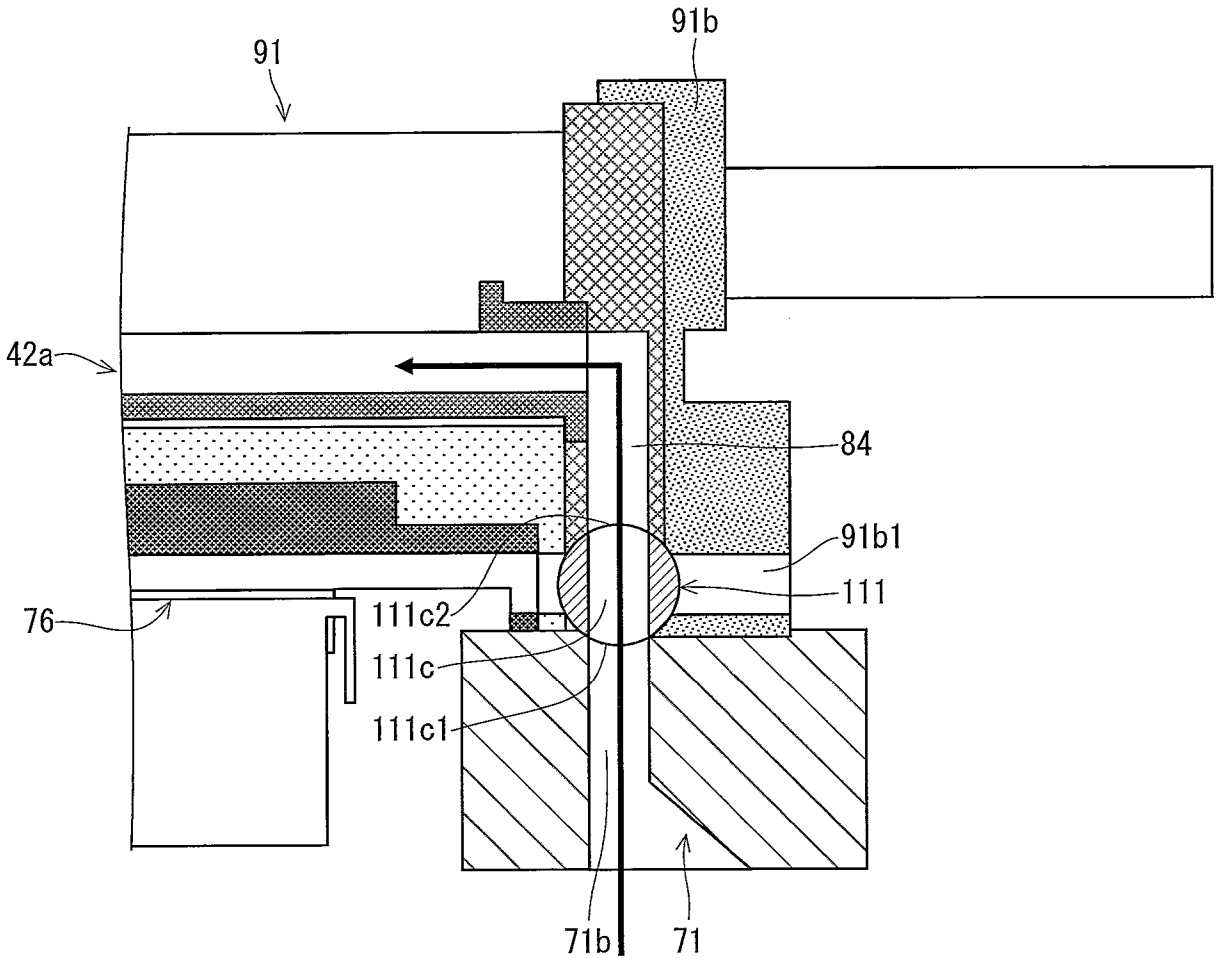
FIG. 15 is an elevation view of the longitudinal cross section illustrated in FIG. 14.
Figure 16:
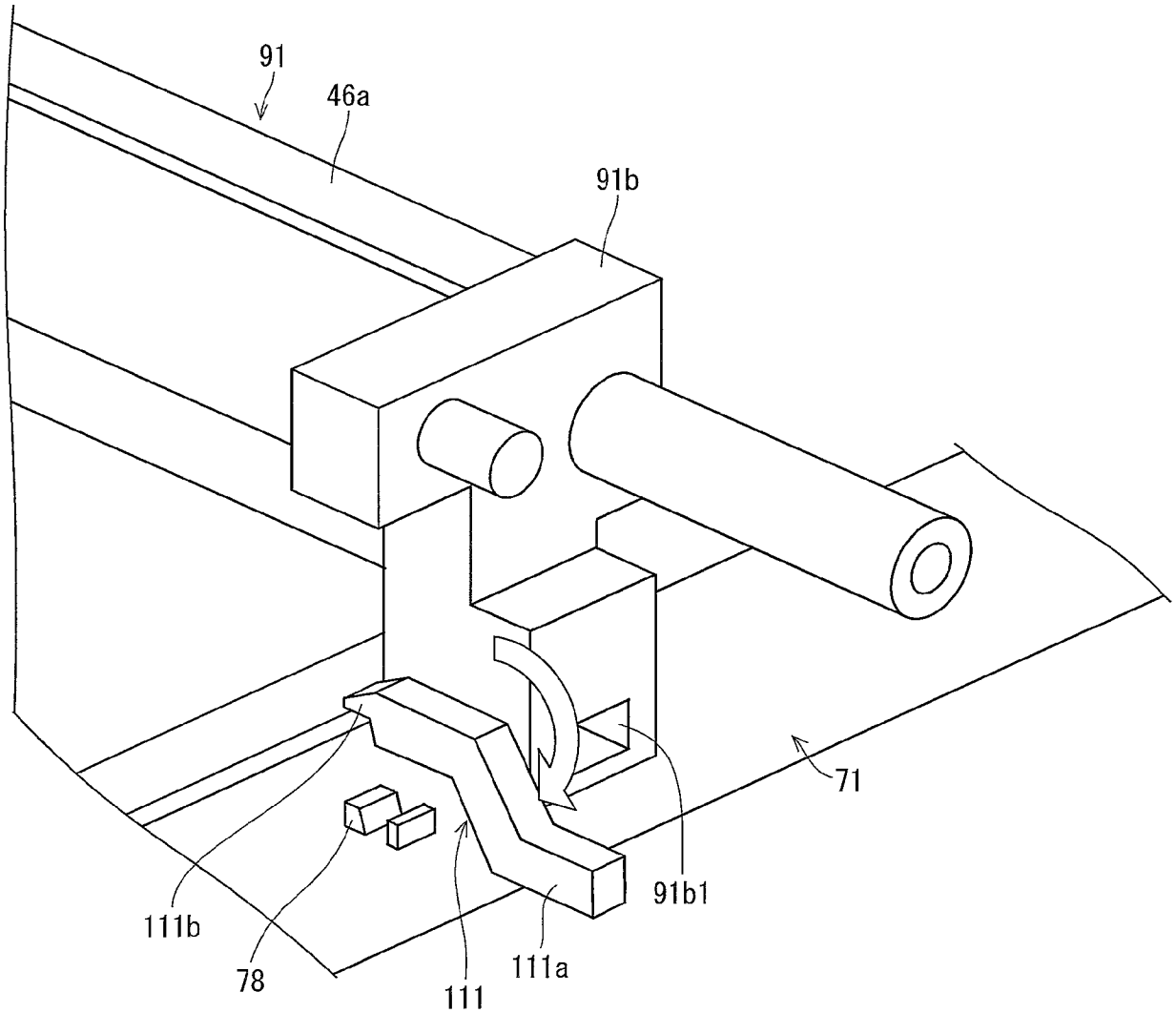
FIG. 16 is a perspective view illustrating structures of the positioning lever and its peripherals when the positioning lever is in a releasing state.
Figure 17:
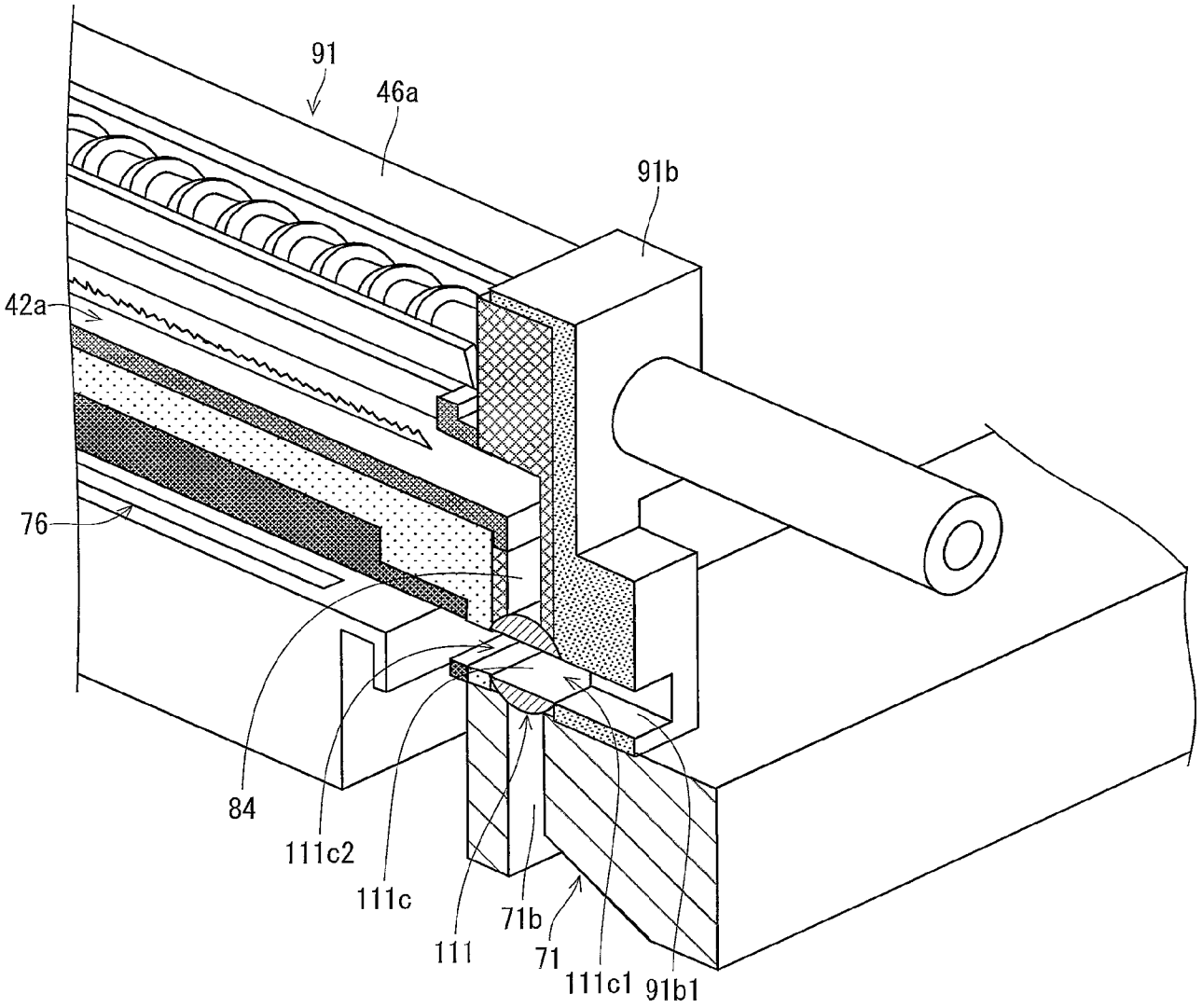
FIG. 17 is a longitudinal cross section view illustrating structures of the positioning lever and its peripherals in the state illustrated in FIG. 16.
Figure 18:
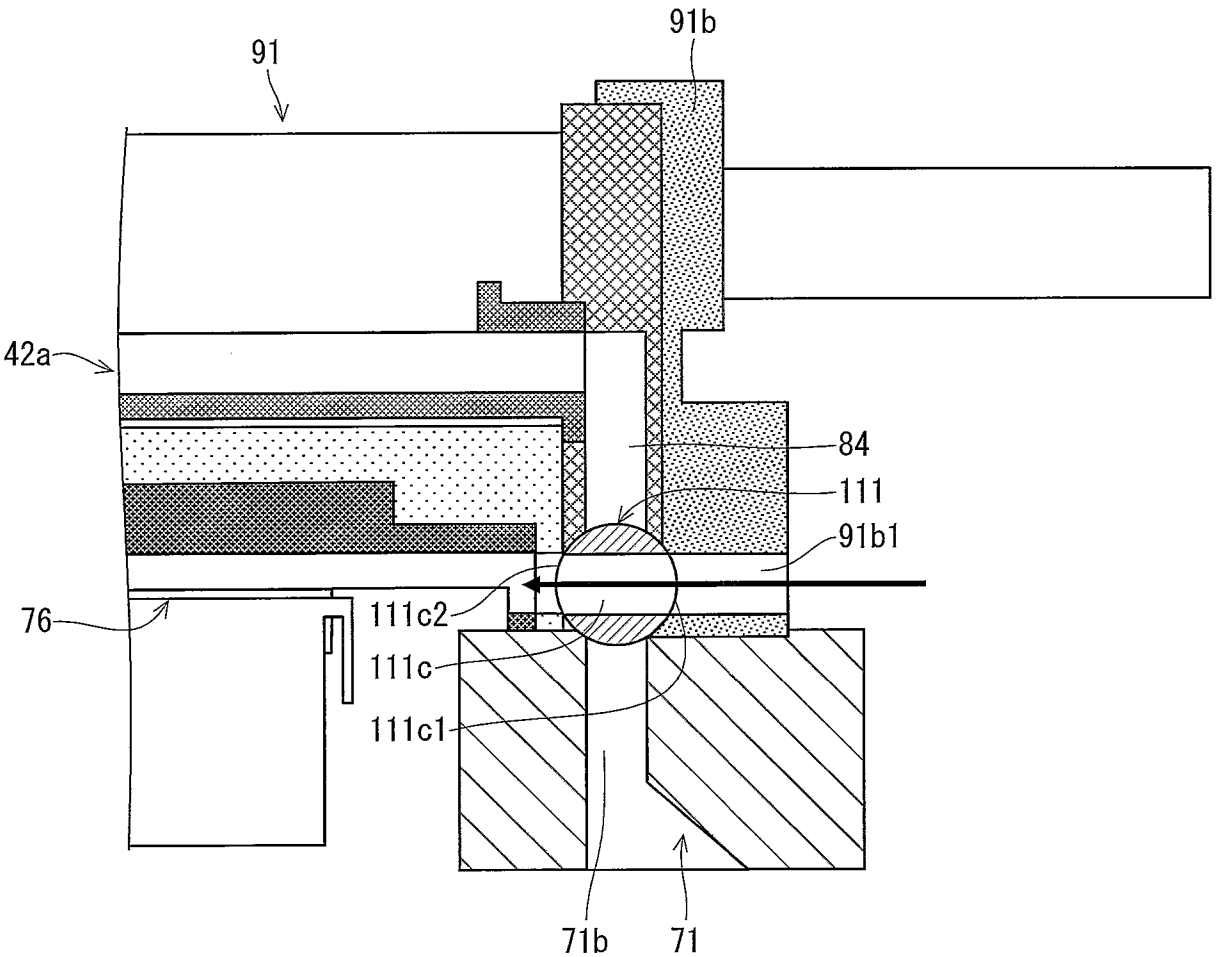
FIG. 18 is an elevation view of the longitudinal cross section illustrated in FIG. 17.

FIG. 13 is a perspective view illustrating structures of the positioning lever 111 and its peripherals of the image forming apparatus 1 in accordance with the present embodiment when the positioning lever 111 is in a positioning state. FIG. 14 is a longitudinal cross section view illustrating structures of the positioning lever 111 and its peripherals in the state illustrated in FIG. 13. FIG. 15 is an elevation view of the longitudinal cross section illustrated in FIG. 14. FIG. 16 is a perspective view illustrating structures of the positioning lever 111 and its peripherals when the positioning lever 111 is in a releasing state. FIG. 17 is a longitudinal cross section view illustrating structures of the positioning lever 111 and its peripherals in the state illustrated in FIG. 16. FIG. 18 is an elevation view of the longitudinal cross section illustrated in FIG. 17. For convenience, in FIGS. 13 to 18, the process unit 91 is illustrated as being in a state where the photoreceptor drum 41*a* has been detached from the process unit 91.

The process unit 91 includes, at a front end thereof, a unit support member 91*b* for supporting components of the process unit 91. The unit support member 91*b* is provided with the positioning lever 111.

The positioning lever 111 can be rotated by a manual handling between a positioning position (positioning state) illustrated in FIGS. 13 to 15 and a releasing position (releasing state) illustrated in FIGS. 16 to 18. An angle of rotation is approximately 90 degrees. In the present embodiment, the center of rotation of the positioning lever 111 is at a center in up and down directions of a portion of the positioning lever 111 which portion includes an air path 111*c*.

As with the positioning lever 81, the positioning lever 111 positions the process unit 91 attached onto the LSU 12 in such a manner that the process unit 91 is positioned at a predetermined position in front and rear directions of the image forming apparatus 1. For this purpose, the positioning lever 111 includes a handling section 111*a* via which a user handles the positioning lever 111, as illustrated in FIGS. 13 and 16. Furthermore, the positioning lever 111 includes a positioning protrusion 111*b* at an end thereof opposite to the handling section 111*a*.

Engaging protrusions 78 are provided on a top surface of the intake duct 71 in such a manner as to receive the positioning protrusion 111*b*. The positioning protrusion 111*b* of the positioning lever 111 engages with the engaging protrusions 78 in a state where the positioning lever 111 is in a positioning position (see FIG. 13). Consequently, the process unit 91 is positioned in front and rear directions of the image forming apparatus 1.

The positioning lever 111 has therein the air path 111*c* which penetrates the positioning lever 111 (see FIGS. 14 and 15). The air path 111*c* is positioned to be along up and down directions of the process unit 91 when the positioning lever 111 is in the positioning position (see FIG. 15), and is positioned to be along front and rear directions of the process unit 91 (front and rear directions of the image forming apparatus 1) when the positioning lever 111 is in the releasing position (see FIG. 18). The air path 111*c* has an air path entrance 111*c*1 at an end thereof which is positioned closely to a bottom surface of the positioning lever 111 when the positioning lever 111 is in the positioning position, and the air path 111*c* has an air path exit 111*c*2 at an end thereof which is positioned closely to a top surface of the positioning lever 111 when the positioning lever 111 is in the positioning position.

The exhaust opening 71*b* of the intake duct 71 is positioned to be connected with the air path entrance 111*c*1 thereby to communicate with the air path 111*c* when the positioning lever 111 is in the positioning position.

On the other hand, a connecting path 84 connected with a housing of the charging device 42*a* is positioned to be connected with the air path exit 111*c*2. Consequently, the connecting path 84, the charging device 42*a*, and the exhaust duct 72 constitute an exhaust path.

As illustrated in FIGS. 14 and 15, when the positioning lever 111 is in the positioning position, the intake opening 71*a* of the intake duct 71 is connected with the air path entrance 111*c*1 of the air path 111*c*. Furthermore, the connecting path 84 connected with the housing of the charging device 42*a* is connected with the air path exit 111*c*2 of the air path 111*c*.

An opening (not illustrated) of the housing of the charging device 42*a* which opening is opposite to the opening connected with the connecting path 84 is connected with the exhaust duct 72. Consequently, when the positioning lever 111 is in the positioning position, rotation of an exhaust fan 74 takes in air via the intake opening 71*a* of the intake duct 71, and the air passes through the intake duct 71, the air path 111*c* of the positioning lever 111, the connecting path 84, the charging device 42*a*, and the exhaust duct 72, and is exhausted to the outside of the image forming apparatus 1 via the exhaust opening 72*a* of the exhaust duct 72.

A cleaning path 91*b*1 of the unit support member 91*b* is positioned to be connected with the air path entrance 111*c*1 thereby to communicate with the air path 111*c* when the positioning lever 111 is in the releasing position. The cleaning path 91*b*1 penetrates the unit support member 91*b* in front and rear directions of the unit support member 91*b* and opens at a front surface of the unit support member 91*b*.

On the other hand, the LSU lens 76 of the LSU 12 is positioned in the downstream of the air path exit 111*c*2.

With the arrangement, when the process unit 91 is attached onto the LSU 12 of the image forming apparatus 1, putting the positioning lever 111 in the positioning position (positioning state) allows positioning the process unit 91 in a predetermined attaching position, as illustrated in FIGS. 13 to 15.

Furthermore, in this state, rotation of the exhaust fan 74 takes in air via the intake opening 71*a* of the intake duct 71, and the air passes through the intake duct 71, the air path 111*c* of the positioning lever 111, the connecting path 84, the charging device 42*a*, and the exhaust duct 72, and is exhausted to the outside of the image forming apparatus 1 via the exhaust opening 72*a* of the exhaust duct 72. Consequently, it is possible to exhaust ozone generated by corona discharge of the charging device 42*a* to the outside of the image forming apparatus 1.

On the other hand, in a case of cleaning the top surface of the LSU lens 76, the positioning lever 111 is put in the releasing position (releasing state) as illustrated in FIGS. 16 to 18. This connects the air path 111*c* of the positioning lever 111 with the cleaning path 91*b*1 of the unit support member 91*b*. Consequently, it is possible to clean the top surface of the LSU lens 76 by inserting the LSU cleaning rod (cleaning member) 82 via the cleaning path 91*b*1. In this case, the LSU cleaning rod 82 can be lead to reach the top surface of the LSU lens 76 via the cleaning path 91*b*1 and the air path 111*c*, thereby making it easy to clean the top surface of the LSU lens 76.

When the positioning lever 111 is put in the releasing position, the outer surface of the positioning lever 111 blocks the entrance of the connecting path 84. Accordingly, it is possible to prevent foreign matters from entering into the charging device 42*a* when the positioning lever 111 is in the releasing position.

As described above, the positioning lever 111 has (i) a function of positioning the process unit 91 in front and rear directions of the image forming apparatus 1, (ii) a function of an air path via which air is sent to the charging device 42*a*, and (iii) a function of a path via which the LSU lens 76 is cleaned. Consequently, the image forming apparatus 1 having a mechanism for positioning the process unit 91 and a mechanism for sending air to the charging device 42*a* can be designed to be downsized and occupy a smaller space.

Third Embodiment

In the above embodiments, a description was provided as to examples where the positioning lever 81 or 111 is provided at the process unit 91. Alternatively, the positioning lever 81 or 111 may be provided at a position other than the process unit 91 (position at the image forming apparatus 1), e.g. on a fixing member such as a frame included in the image forming apparatus 1.

Fourth Embodiment

In the above embodiments, a description was provided as to a case where the image forming apparatus 1 is a full-color printer. Alternatively, the image forming apparatus 1 may be a monochrome printer. In this case, the process unit to be attached onto the image forming apparatus 1 is only one, i.e. a process unit for monochrome printing.

Fifth Embodiment

FIG. 3 illustrates a case where the intake fan 73 is provided, and FIGS. 4 to 6 illustrate a case where the intake fan 73 is not provided. The intake fan 73 is provided in the intake duct 71. In a case where the exhaust fan 74 is provided, the intake fan 73 may be omitted as illustrated in FIGS. 4 to 6. However, provision of the intake fan 73 enhances intake efficiency.

SUMMARY

An image forming apparatus in accordance with first aspect of the present invention is an image forming apparatus for forming an image based on an electrophotographic printing method, including: a process unit 91 detachable from the image forming apparatus, the process unit 91 including at least a photoreceptor (photoreceptor drum 41*a*) and a charging section (charging device 42*a*) for charging the photoreceptor; an exhaust path (connecting path 83, charging device 42*a*, exhaust duct 72) having, as a part of the exhaust path, a space where the charging section is provided; and a positioning member (positioning lever 81) movable between (i) a positioning position for putting the process unit 91 in a positioned state where the process unit 91 is positioned at a predetermined position and (ii) a releasing position for releasing the process unit 91 from the positioned state, the positioning member having an air path 81*c* via which air is introduced, the air path 81*c* and the exhaust path being connected in a case where the positioning member is in the positioning position, and the air path 81*c* and the exhaust path being disconnected in a case where the positioning member is in the releasing position.

With the arrangement, putting the positioning member (positioning lever 81) in the positioning position puts the process unit 91 in the positioned state where the process unit 91 is positioned at the predetermined position, and at the same time connects the air path 81*c* of the positioning member with the exhaust path (connecting path 83, charging device 42*a*, exhaust duct 72). On the other hand, putting the positioning member in the releasing position releases the process unit 91 from the positioned state, and at the same time disconnects the air path 81*c* of the positioning member from the exhaust path.

Consequently, putting the positioning member in the releasing position allows taking air from the air path 81*c* of the positioning member into the exhaust path, so that air in the space where the charging section is provided is exhausted via the exhaust path. This allows exhausting ozone generated by discharge in the charging section.

As described above, the positioning member has a function of positioning the process unit and a function of an air path via which air is introduced into the exhaust path. This allows an image forming apparatus to be designed such that a mechanism for positioning the process unit and a mechanism for exhausting ozone generated in the charging section are downsized and occupy a smaller space.

An image forming apparatus in accordance with second aspect of the present invention may be the image forming apparatus in accordance with the first aspect, further including a laser radiating device (laser scanning unit 12) for radiating laser light via a covering member (LSU lens 76) to the photoreceptor (photoreceptor drum 41*a*) so as to form an electrostatic latent image on the photoreceptor, the covering member being provided on a top surface of the laser radiating device, the process unit 91 being attached onto the laser radiating device, and the positioning member (positioning lever 111) having the air path 111*c* in such a manner that the air path 111*c* penetrates the positioning member, and in a case where the positioning member is in the releasing position, a direction from the air path entrance 111*c*1 to the air path exit 111*c*2 extends toward where the covering member is provided.

With the arrangement, the air path 111*c* of the positioning member (positioning lever 111) penetrates the positioning member, and in a case where the positioning member is in the releasing position, the direction from the air path entrance 111*c*1 to the air path exit 111*c*2 extends toward where the covering member is provided.

Consequently, while the positioning member is in the releasing position, it is possible to insert a cleaning member having, for example, a bar shape, via the air path entrance 111*c*1 to the air path exit 111*c*2 of the air path 111*c* of the positioning member, and easily clean the top surface of the covering member of the laser radiating device.

In this case, the air path 111*c* in the releasing position and the exhaust path are disconnected. This can prevent dirty air as a result of the cleaning from flowing into the charging section (charging device 42*a*).

An image forming apparatus in accordance with third aspect of the present invention may be the image forming apparatus in accordance with the second aspect, wherein the air path 111*c* of the positioning member (positioning lever 111) extends linearly from the air path entrance 111*c*1 to the air path exit 111*c*2.

With the arrangement, the air path 111*c* of the positioning member extends linearly from the air path entrance 111*c*1 to the air path exit 111*c*2. Consequently, it is possible to insert via the air path 111*c* a cleaning member (LSU cleaning rod 82) having, for example, a bar shape, and easily clean the top surface of the covering member (LSU lens 76) of the laser radiating device (laser scanning unit 12).

An image forming apparatus in accordance with fourth aspect of the present invention may be the image forming apparatus in accordance with the first aspect, further including a laser radiating device (laser scanning unit 12) for radiating laser light via a covering member (LSU lens 76) to the photoreceptor (photoreceptor drum 41*a*) so as to form an electrostatic latent image on the photoreceptor, the covering member being provided on a top surface of the laser radiating device, the process unit being attached onto the laser radiating device, and between the positioning member (positioning lever 81) in the releasing position and the top surface of the laser radiating device, there being provided a space via which a cleaning member (LSU cleaning rod 82) for cleaning a top surface of the covering member of the laser radiating device is inserted.

With the arrangement, putting the positioning member (positioning lever 81) in the releasing position provides, between the positioning member and the top surface of the laser radiating device (laser scanning unit 12), a space via which the cleaning member (LSU cleaning rod 82) for cleaning the top surface of the covering member (LSU lens 76) of the laser radiating device is inserted. Consequently, while in this state, it is possible to insert via the space a cleaning member (LSU cleaning rod 82) having, for example, a bar shape, and easily clean the top surface of the covering member of the laser radiating device.

In this case, the air path 81*c* in the releasing position and the exhaust path are disconnected. This can prevent dirty air as a result of the cleaning from flowing into the charging section (charging device 42*a*).

An image forming apparatus in accordance with fifth aspect of the present invention is the image forming apparatus in accordance with any one of the first to fourth aspects, wherein the positioning member (positioning lever 81, 111) is switched between the positioning position and the releasing position by rotation of the positioning member.

With the arrangement, the positioning member (positioning lever 81, 111) is movable between the positioning position and the releasing position without moving in a wide range.

The present invention is not limited to the description of the embodiments above, but may be altered by a skilled person within the scope of the claims. An embodiment based on a proper combination of technical means disclosed in different embodiments is encompassed in the technical scope of the present invention. Furthermore, a new technical feature can be provided by combining technical means disclosed in individual embodiments.

INDUSTRIAL APPLICABILITY

The present invention is applicable to a copying machine, a printer, a multifunction printer etc. which includes a process unit and charges a photoreceptor by corona discharge.

REFERENCE SIGNS LIST

1 Image forming apparatus
11 Image forming section
12 Laser scanning unit (laser radiating device)
31 First image forming section
32 Second image forming section
33 Third image forming section
34 Fourth image forming section
41*a*-41*d* Photoreceptor drum (photoreceptor)
42*a*-42*d* Charging device (charging section, exhaust path)
45*a*-45*d* Photoreceptor cleaner unit
46*a*-46*d* Charge removing section
71 Intake duct
71*a* Intake opening
71*b* Exhaust opening
72 Exhaust duct (exhaust path)
72*a* Exhaust opening
74 Exhaust fan
75 Guide rail
76 LSU lens (covering member)
77 Gutter section
77*a* Positioning hole
77*b* Through-hole
81 Positioning lever (positioning member)
81*a* Handling section
81*b* Positioning protrusion
81*c* Air path
81*c*1 Air path entrance
81*c*2 Air path exit
82 LSU cleaning rod (cleaning member)
83 Connecting path (exhaust path)
84 Connecting path (exhaust path)
91 Process unit
91*a* Rail
91*b* Unit support member
91*b*1 Cleaning path
111 Positioning lever (positioning member)
111*a* Handling section
111*b* Positioning protrusion
111*c* Air path
111*c*1 Air path entrance
111*c*2 Air path exit

The invention claimed is:

1. An image forming apparatus for forming an image based on an electrophotographic printing method, comprising:

a process unit detachable from the image forming apparatus, the process unit including at least a photoreceptor and a charging section for charging the photoreceptor;

an exhaust path having, as a part of the exhaust path, a space where the charging section is provided; and a positioning member movable between (i) a positioning position for putting the process unit in a positioned state where the process unit is positioned at a predetermined position and (ii) a releasing position for releasing the process unit from the positioned state, the positioning member having an air path via which air is introduced, the air path and the exhaust path being connected in a case where the positioning member is in the positioning position, and the positioning member including a tab via which a user handles the positioning member so that the positioning member is switched between the positioning position and the releasing position.

2. The image forming apparatus as set forth in claim 1, further comprising a positioning hole, wherein:

the positioning member further includes a positioning protrusion which is inserted into the positioning hole; and in a case where the user handles the tab so that the positioning protrusion is inserted into the positioning hole, the positioning member is in the positioning position.

3. The image forming apparatus as set forth in claim 1, wherein, in a case where the user handles the tab so that the positioning member is rotated, the positioning member is switched between the positioning position and the releasing position.

4. An image forming apparatus for forming an image based on an electrophotographic printing method, comprising:

a process unit detachable from the image forming apparatus, the process unit including at least a photoreceptor and a charging section for charging the photoreceptor;

an exhaust path having, as a part of the exhaust path, a space where the charging section is provided;

a positioning member movable between (i) a positioning position for putting the process unit in a positioned state where the process unit is positioned at a predetermined position and (ii) a releasing position for releasing the process unit from the positioned state, the positioning member having an air path via which air is introduced, the air path and the exhaust path being connected in a case where the positioning member is in the positioning position; and a laser radiating device for radiating laser light via a covering member to the photoreceptor so as to form an electrostatic latent image on the photoreceptor, in a case where the positioning member is in the releasing position, a top surface of the covering member being communicated with an outside of the image forming apparatus, in a case where the positioning member is in the positioning position, the top surface of the covering member being shielded from the outside of the image forming apparatus.

5. The image forming apparatus as set forth in claim 4, wherein:

the air path of the positioning member penetrates the positioning member; and in a case where the positioning member is in the positioning position, the top surface of the covering member is communicated with the outside of the image forming apparatus via the air path.

6. The image forming apparatus as set forth in claim 4, wherein the air path of the positioning member extends linearly from an entrance of the air path to an exit of the air path.

7. The image forming apparatus as set forth in claim 4, wherein, in a case where the positioning member is in the releasing position, there is provided, between the positioning member and a top surface of the laser radiating device, a space via which a cleaning member for cleaning the top surface of the covering member is inserted.

* * * * *